US009004931B2

(12) United States Patent
Montena

(10) Patent No.: US 9,004,931 B2
(45) Date of Patent: Apr. 14, 2015

(54) COAXIAL INTERFACE PORT ACCESSORY AND PORT FACILITATING SLIDE-ON ATTACHMENT AND ROTATIONAL DETACHMENT OF CABLE CONNECTORS

(71) Applicant: PPC Broadband, Inc., East Syracuse, NY (US)

(72) Inventor: Noah P. Montena, Syracuse, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 0 days.

(21) Appl. No.: 14/291,832

(22) Filed: May 30, 2014

(65) Prior Publication Data

US 2014/0342594 A1 Nov. 20, 2014

Related U.S. Application Data

(63) Continuation-in-part of application No. 13/157,340, filed on Jun. 10, 2011, now Pat. No. 8,758,050.

(51) Int. Cl.

| | |
|---|---|
| ***H01R 4/38*** | (2006.01) |
| ***H01R 9/05*** | (2006.01) |
| ***H01R 13/622*** | (2006.01) |
| ***H01R 13/627*** | (2006.01) |
| ***H01R 24/38*** | (2011.01) |
| ***H01R 25/00*** | (2006.01) |

(52) U.S. Cl.

CPC ..... *H01R 9/0524* (2013.01); *H01R 9/05* (2013.01); *H01R 13/622* (2013.01); *H01R 13/6275* (2013.01); *H01R 24/38* (2013.01); *H01R 25/003* (2013.01)

(58) Field of Classification Search

CPC ..... H01R 9/0524; H01R 9/05; H01R 13/6275
USPC ..... 439/63, 253, 357, 502, 578
See application file for complete search history.

(56) References Cited

U.S. PATENT DOCUMENTS

| | | | |
|---|---|---|---|
| 6,267,612 | B1 | 7/2001 | Arcykiewicz et al. |
| 6,769,926 | B1 | 8/2004 | Montena |
| 7,811,112 | B2 | 10/2010 | Montena |
| 8,221,161 | B2 | 7/2012 | Leibfried, Jr. |
| 8,388,377 | B2 | 3/2013 | Zraik |
| 8,414,322 | B2 | 4/2013 | Montena |
| 8,430,687 | B2 | 4/2013 | Zraik |

(Continued)

FOREIGN PATENT DOCUMENTS

| | | | |
|---|---|---|---|
| EP | 1115179 | A2 | 7/2001 |
| JP | 2007012531 | A | 1/2007 |

OTHER PUBLICATIONS

European Patent Office, Extended European Search Report from European Patent Appl. No. 12796262 as completed Jan. 26, 2015; mailed Feb. 2, 2015 (total 22 pgs.).

*Primary Examiner* — Khiem Nguyen
(74) *Attorney, Agent, or Firm* — Hiscock & Barclay, LLP

(57) ABSTRACT

A coaxial interface port accessory and port comprises, in one embodiment, a conductor portion configured to: (i) electrically communicate with a grounding conductor of a coaxial cable connector, (ii) axially engage a working surface of the coaxial cable connector to couple the connector to a coaxial interface port, and (iii) rotationally disengage the working surface the threaded coupler of the coaxial cable connector.

20 Claims, 17 Drawing Sheets

(56) References Cited

U.S. PATENT DOCUMENTS

| | | | |
|---|---|---|---|
| 8,454,395 | B2 | 6/2013 | Xu et al. |
| 8,491,333 | B2 | 7/2013 | Evans |
| 2007/0020973 | A1 | 1/2007 | Sattele |
| 2007/0087613 | A1 | 4/2007 | Schumacher |
| 2010/0081321 | A1 | 4/2010 | Malloy |
| 2010/0186228 | A1 | 7/2010 | Montena |
| 2011/0053395 | A1 | 3/2011 | Leibfried |
| 2012/0021642 | A1 | 1/2012 | Zraik |
| 2012/0028499 | A1 | 2/2012 | Zraik |
| 2012/0270440 | A1 | 10/2012 | Zraik |

COAXIAL INTERFACE PORT ACCESSORY AND PORT FACILITATING SLIDE-ON ATTACHMENT AND ROTATIONAL DETACHMENT OF CABLE CONNECTORS

PRIORITY CLAIM

This application is a continuation-in-part of, and claims the benefit and priority of, U.S. patent application Ser. No. 13/157,340, filed on Jun. 10, 2011. The entire contents of such application are hereby incorporated by reference.

BACKGROUND

Connectors for coaxial cables are typically connected onto complementary interface ports to electrically integrate coaxial cables to various electronic devices. Push-on connectors have been used by consumers for their ease of use, however, over time, such connectors do not remain properly attached to the interface port. For example, push-on connectors can slip off the port if sufficient friction is not maintained between the connector and the port. Such friction forces are a function of the manufacturing tolerances which must be maintained during fabrication. It will be appreciated that it is difficult and/or costly to produce a friction fit, push-on connector which generates sufficient friction between the interface surface of the connector and the external threads of the port. By contrast, conventional, threaded connectors can provide a sufficient retention force, up to the yield strength of a coaxial cable; however, conventional, threaded connectors must also be fully and carefully rotated onto the port during installation. Furthermore, it is desirable to maintain electrical continuity through a coaxial cable connector. This typically involves a creation of a continuous electrical path across the conductive components of the connector and the interface port to maintain a reliable ground connection and an efficient RF shield.

Complementary threaded RF ports and a corresponding threaded connector require several turns or revolutions to fully engage. This can be difficult to achieve because such ports are routinely inaccessible, located on the back or reverse side of an RF device, such as the back of a TV or modem. As a consequence, threaded connectors may not be fully engaged, leading to poor ground and RF performance. Furthermore, a loose connection can adversely impact the entire cable network rather than just the performance of a single RF device.

Therefore, there is a need to overcome, or otherwise lessen the effects of, the disadvantages and shortcomings described above.

SUMMARY

A first general aspect relates to a coupling member comprising a body defined by an inner surface and an outer surface between a first end a second end, at least one resilient contact extending a distance from the inner surface of the body, the at least one resilient contact configured to provide a retention force, and at least one resilient protrusion extending a distance from the inner surface of the body, the at least one resilient positioned proximate the second end of the body and configured to contact a conductive surface.

A second general aspect relates to a coaxial cable connector for mating with an interface port having external threads, comprising a post configured to receive a center conductor surrounded by a dielectric of a coaxial cable, a connector body attached to the post, a coupling member attached to the post, the coupling member having one or more resilient contacts, wherein the resilient contacts are configured to pass over the external threads in a first axial direction, and physically engage the external threads in a second axial direction.

A third general aspect relates to a coaxial cable connector for connecting to an interface port comprising a post having configured to receive a prepared end of a coaxial cable having a center conductor surrounded by a dielectric, a connector body attached to the post, a coupling member attached to the post, the coupling member having a first end and a second end, wherein the coupling member includes a first set of contacts proximate the second end configured to maintain electrical continuity between the coupling member and the post, and a second set of contacts configured to provide a retention force in an axial direction between the coupling member and the port.

A fourth general aspect relates to a coaxial cable connector adapted to mate with a port, comprising a post configured to receive a center conductor surrounded by a dielectric of a coaxial cable, a connector body attached to the post, a coupling member operably attached to the post, the coupling member having a first end and a second end, and a means for providing a retention force in an axial direction between the coupling member and the port, wherein the means for providing the retention force is integral with the coupling member.

A fifth general aspect relates to a connector for connecting to an interface port comprising a post having configured to receive a prepared end of a coaxial cable having a center conductor surrounded by a dielectric, a connector body attached to the post, a coupling member, the coupling member having a first end and a second end, wherein the coupling member includes a first set of contacts proximate the second end configured to maintain electrical continuity through the connector, and a second set of contacts configured to provide a retention force in an axial direction between the coupling member and the port.

A sixth general aspect relates to a method of retaining a connector onto a port in an axial direction, comprising providing a post configured to receive a center conductor surrounded by a dielectric of a coaxial cable, a connector body attached to the post, a coupling member attached to the post, wherein the coupling member has a first and second end, and forming one or more resilient contacts on the coupling member, wherein the resilient contacts are configured to pass over the external threads in a first axial direction, and physically engage the external threads in a second axial direction.

A seventh general aspect relates to a jumper comprising a first connector, wherein the first connector includes a post configured to receive a center conductor surrounded by a dielectric of a coaxial cable, a connector body attached to the post, and a coupling member attached to the post, the coupling member having one or more resilient contacts, wherein the resilient contacts are configured to pass over the external threads in a first axial direction, and physically engage the external threads in a second axial direction, and a second connector, wherein the first connector is operably affixed to a first end of a coaxial cable, and the second connector is operably affixed to a second end of the coaxial cable.

An eighth general aspect relates to a coaxial interface port accessory for coaxial cable connections. In one embodiment, the coaxial interface port accessory comprises a outer conductor portion configured to be in electrical communication with an outer conductor of a coaxial cable connector. The outer conductor portion is: (i) configured to be inserted onto or incorporated into a coaxial interface port of an electrical device, resulting in an integrated interface port or port adaptation; (ii) configured to slideably receive and axially engage a threaded coupler of the coaxial cable connector during installation of connector; (iii) configured to be in electrical communication with a grounding conductor of the coaxial cable connector; and (iv) configured to enable the connector to be removed from the integrated interface port by rotating, or unscrewing, the connector.

In another embodiment, a conductive outer body comprises a cylindrical outer periphery defining an elongate axis and an annular rim extending inwardly toward the axis from a forward portion of the outer periphery. The conductive outer body produces a internal void or cavity for receiving an inner conductor which is electrically insulated from the outer body by a dielectric core. The outer periphery. comprises a plurality of resilient elements, contacts, or tabs which are spaced-apart along the circumference of the outer periphery. Each of the tabs comprises a connected or integrated end which connects to the body and a free end which is displaced further away from the axis than the connected end. Each of the free ends comprises an angled edge oriented so as to be threadably compatible with a working or thread profile surface of a thread of a coaxial cable connector. The tabs are configured to move between a predisposed position and an engaged position.

In the predisposed position, the free ends are further away from the axis than the connected ends, and in the engaged position, the free ends are closer to the axis in response to engaging a working surface, thread profile surface or thread portion of a thread. The engaged position results when a connector is pushed in a forward direction along the axis to at least partially receive the body and when the free ends engage the thread portion of the thread to counteract the pulling force on the coaxial cable connector along the axis in a rearward direction. The angled edges are configured to enable the coaxial cable connector to be rotatably removed from the coaxial interface device. Furthermore, in another embodiment, the free end of one resilient contact or tab may extend an axial distance from the connected end which may vary from the axial distance of another resilient tab. Also, in another embodiment, the free end of one resilient tab may extend radial distance from the elongate axis which is radially outboard of the radial distance of the free end of another resilient tab.

Additional features and advantages of the present disclosure are described in, and will be apparent from, the following Brief Description of the Drawings and Detailed Description.

DETAILED DESCRIPTION

Connector Interface for Coaxial Cable Connection

Figure 1:
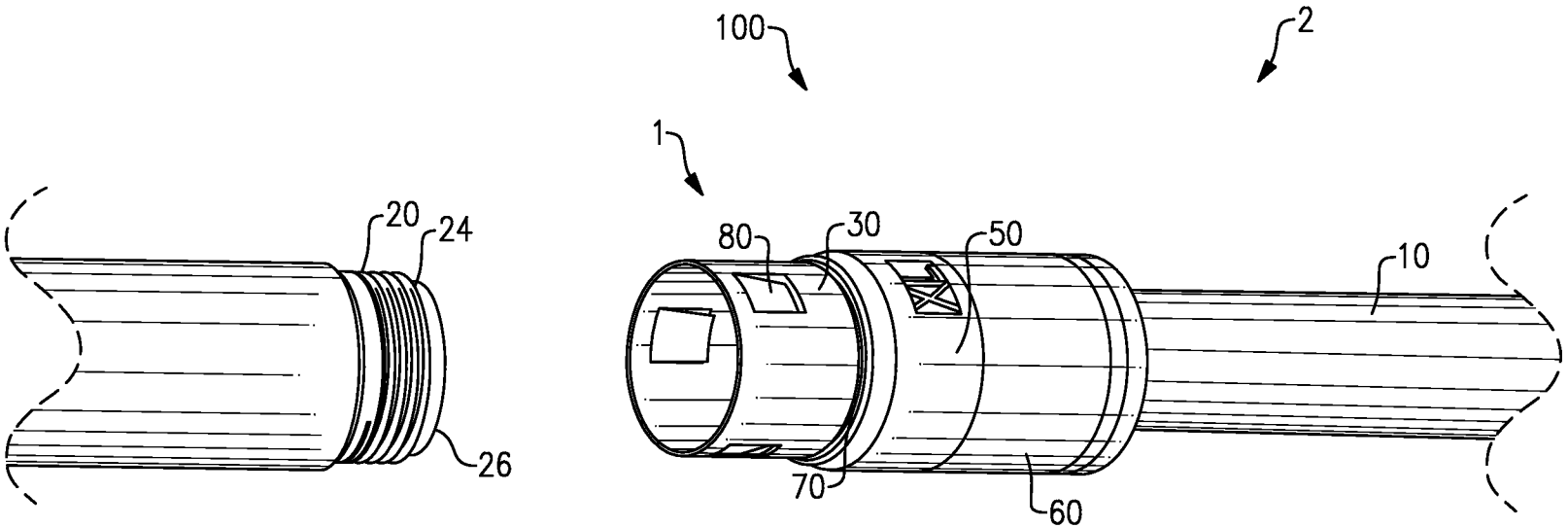
FIG. 1 depicts a perspective view of a first embodiment of a coaxial cable connector.
Figure 12:
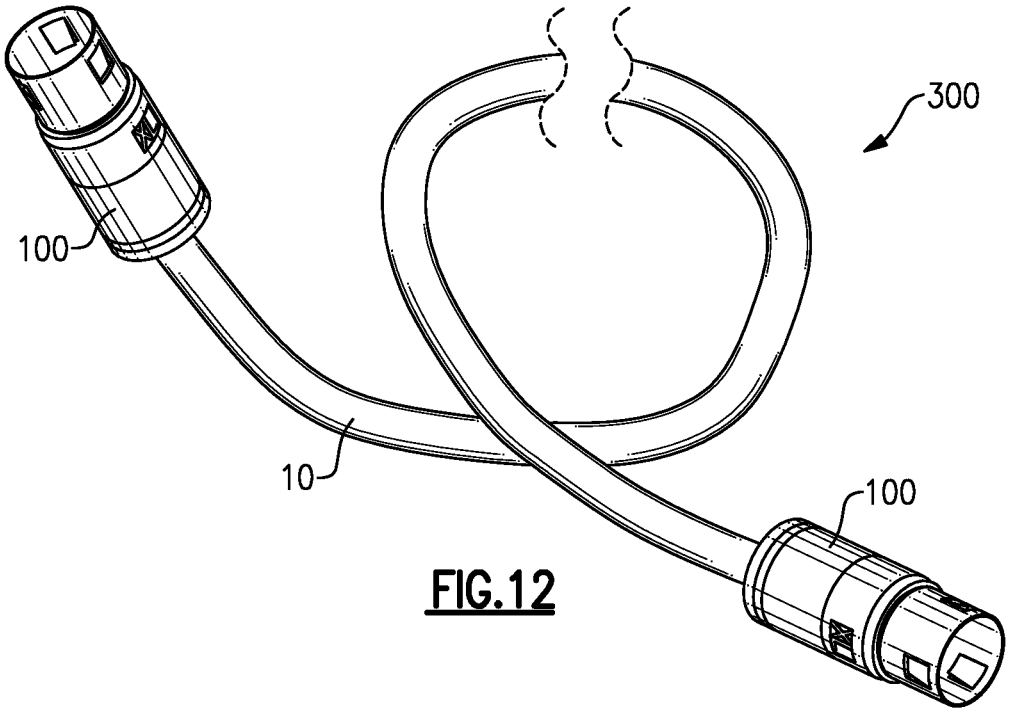
FIG. 12 depicts an perspective view of an embodiment of a jumper.

Referring to the drawings, FIG. 1 depicts an embodiment of a coaxial cable connector 100. A coaxial cable connector embodiment 100 has a first end 1 and a second end 2, and can be provided to a user in a preassembled configuration to ease handling and installation during use. The coaxial cable connector 100 may be a push-on connector, push-on F connector, or similar coaxial cable connector that requires only an axial force to mate with a corresponding port 20 (e.g., does not require lining up threads and rotating a coupling member). Two connectors, such as connector 100 may be utilized to create a jumper 300 that may be packaged and sold to a consumer, as shown in FIG. 12. The jumper 300 may be a coaxial cable 10 having a connector, such as connector 100, operably affixed at one end of the cable 10 where the cable 10 has been prepared, and another connector, such as connector 100, operably affixed at the other prepared end of the cable 10.

The jumper 300 may be in an uncompressed/open position and a compressed/closed position while affixed to the cable. For example, embodiments of jumper 300 may include a first connector including components/features described in association with connector 100, and a second connector that may also include the components/features as described in association with connector 100, wherein the first connector is operably affixed to a first end of a coaxial cable 10, and the second connector is operably affixed to a second end of the coaxial cable 10. One of the first and second connectors may includes some, but not all of the features of the other connector.

Figure 2:
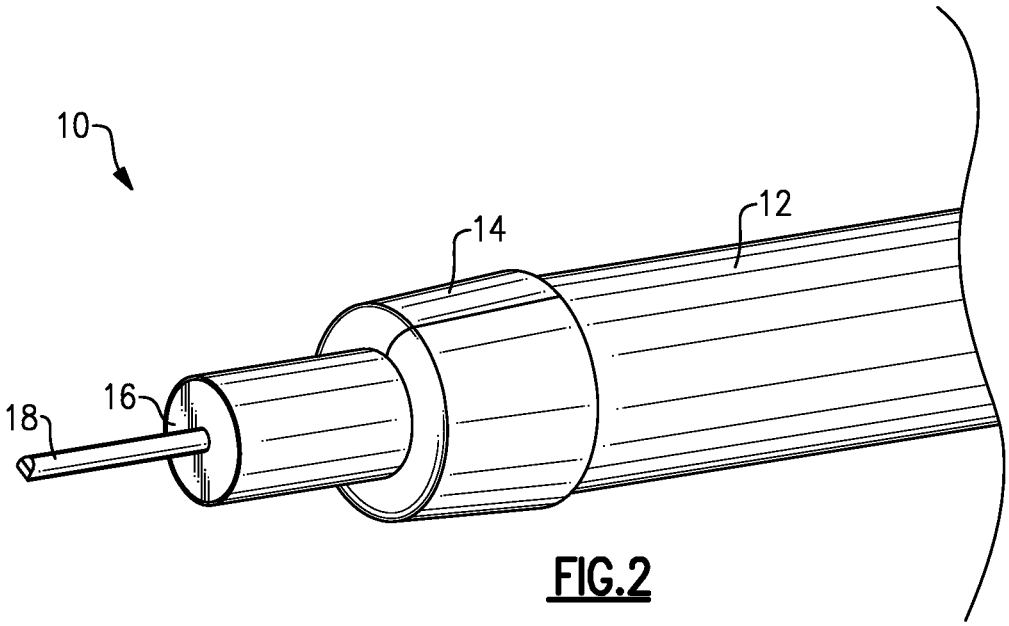
FIG. 2 depicts a perspective view of an embodiment of a coaxial cable.

Referring now to FIG. 2, the coaxial cable connector 100 may be operably affixed to a prepared end of a coaxial cable 10 so that the cable 10 is securely attached to the connector 100. The coaxial cable 10 may include a center conductive strand 18, surrounded by an interior dielectric 16. The interior dielectric 16 may be surrounded by a conductive foil layer which may, in turn, and be surrounded by a conductive strand layer 14. The conductive strand layer 14 is surrounded by a protective outer jacket 12 having dielectric properties to serve as an insulator. The conductive strand layer 14 may provide a grounding path and an electromagnetic shield around the center conductive strand 18 of the coaxial cable 10. The coaxial cable 10 may be prepared by removing the protective outer jacket 12 and drawing back the conductive strand layer 14 to expose a portion of the interior dielectric 16 (and possibly the conductive foil layer that may tightly surround the interior dielectric 16) and the center conductive strand 18. The protective outer jacket 12 may physically protect the various components of the coaxial cable 10 from damage which may result from exposure to dirt, moisture, and corrosion. Also, the protective outer jacket 12 may serve in some measure to secure the various components of the coaxial cable 10 in a contained cable design that protects the cable 10 from damage related to movement during cable installation.

The conductive strand layer 14 can be comprised of conductive materials suitable for carrying electromagnetic signals and/or providing an electrical ground connection or electrical path connection. The conductive strand layer 14 may also be a conductive layer, braided layer, and the like. Various embodiments of the conductive strand layer 14 may be employed to screen unwanted noise or interference. For instance, the conductive strand layer 14 may comprise a metal foil (in addition to the conductive foil) wrapped around the dielectric 16 and/or several conductive strands formed in a continuous braid around the dielectric 16. Combinations of foil and/or braided strands may be utilized wherein the conductive strand layer 14 may comprise alternating foil, braided, and foil layers. Those in the art will appreciate that various layer combinations may be implemented in order for the conductive strand layer 14 to effectuate an electromagnetic shield to preventingress of environmental noise that may disrupt broadband communications. In some embodiments, there may be flooding compounds protecting the conductive strand layer 14. The dielectric 16 may be comprised of materials suitable for electrical insulation. The protective outer jacket 12 may also be comprised of materials suitable for electrical insulation. It should be noted that the various materials should have some degree of elasticity allowing the cable 10 to flex or bend in accordance with traditional broadband communications standards, installation methods and/or equipment. It should further be recognized that the radial thickness of the coaxial cable 10, protective outer jacket 12, conductive strand layer 14, conductive foil layer, interior dielectric 16 and/or center conductive strand 18 may vary depending on recognized parameters corresponding to broadband communication standards and/or equipment.

Referring to FIGS. 1 and 2, the connector 100 may mate with a coaxial cable interface port 20. The coaxial cable interface port 20 includes a conductive receptacle for receiving a portion of a coaxial cable center conductor 18 sufficient to make adequate electrical contact. The coaxial cable interface port 20 may further comprise a threaded exterior surface 24. However, various embodiments may employ a smooth surface, or partially smooth surface, as opposed to a completely threaded exterior surface. Another embodiment of an interface port, slide-on adaptor, or port accessory 600 is depicted and described in FIGS. 13-19. The port accessory 600 described therein includes some of the same structure and/or features as that described and depicted in connection with the connector 100. It should be appreciated that the principle difference relates to side of the connection that a particular structure or feature is affiliated. That is, a structure described in connection with the connector 100 may be incorporated into the port side, rather than the connector side, of the coaxial cable connection. These features will become apparent when discussing the port accessory 600 shown in FIGS. 13-19.

The coaxial cable interface port 20 may comprise a mating edge 26. It should be recognized that the radial thickness and/or the length of the coaxial cable interface port 20 and/or the conductive receptacle may vary based upon generally recognized parameters corresponding to broadband communication standards and/or equipment. Also, the pitch and depth of threads which may be formed upon the threaded exterior surface 24 of the coaxial cable interface port 20 may also vary based upon generally recognized parameters corresponding to broadband communication standards and/or equipment. The threads 24 may also include a working surface, which may be defined by the pitch and depth requirements of the port 20. Furthermore, it should be noted that the interface port 20 may be formed of a single conductive material, multiple conductive materials, or may be configured with both conductive and non-conductive materials corresponding to the electrical interface with a coaxial cable connector, such as connector 100. For example, the threaded exterior surface may be fabricated from a conductive material, while a core 26 may be non-conductive. However, a conductive receptacle 22 should be formed of a conductive material. Further still, it will be understood by those of ordinary skill that the interface port 20 may be embodied by a connective interface component of a communications modifying device such as a signal splitter, a cable line extender, a cable network module and/or the like.

Figure 3:
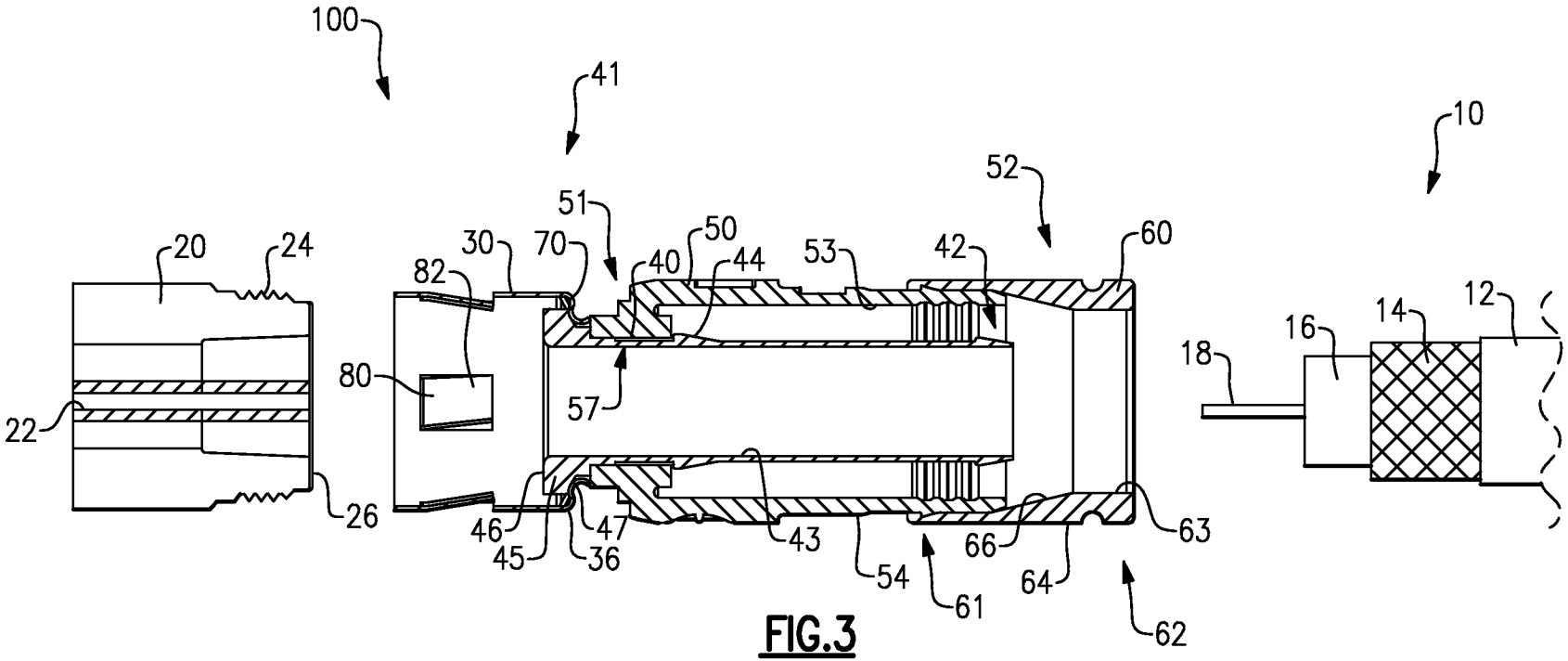
FIG. 3 depicts a cross-sectional view of the embodiment of the connector.

Referring further to FIGS. 1 and 3, embodiments of a connector 100 may include a post 40, a coupling member 30, a connector body 50, a fastener member 60, and a biasing member 70. Embodiments of connector 100 may also include a post 40 configured to receive a center conductor 18 surrounded by a dielectric 16 of a coaxial cable 10, a connector body 50 attached to the post 40, a coupling member 30 attached to the post 40, the coupling member 30 having one or more resilient contacts 80, wherein the resilient contacts 80 are configured to pass over the external threads 24 in a first axial direction, and physically engage the external threads 24 in a second axial direction. Further embodiments of connector 100 may include a post 40 configured to receive a prepared end of a coaxial cable 10 having a center conductor 18 surrounded by a dielectric 16, a connector body 50 attached to the post 40, a coupling member 30 attached to the post 40, the coupling member 30 having a first end 31 and a second end 32, wherein the coupling member 30 includes a first set of contacts 70 proximate the second end 32 configured to maintain electrical continuity between the coupling member 30 and the post 40, and a second set of contacts 80 configured to provide a retention force in an axial direction between the coupling member 30 and the port 20.

Embodiments of connector 100 may include a post 40. The post 40 comprises a first end 41, a second end 42, an inner surface 43, and an outer surface 44. Furthermore, the post 40 may include a flange 45, such as an externally extending annular protrusion, located proximate or otherwise near the first end 41 of the post 40. The flange 45 may include an outer tapered surface 47 facing the second end 42 of the post 40 (i.e. tapers inward toward the second end 42 from a larger outer diameter proximate or otherwise near the first end 41 to a smaller outer diameter.) The outer tapered surface 47 of the flange 45 may correspond to a tapered surface of a lip 36 of the coupling member 30. Further still, an embodiment of the post 40 may include a surface feature such as a lip or protrusion that may engage a portion of a connector body 50 to secure axial movement of the post 40 relative to the connector body 50. However, the post may not include such a surface feature, and the coaxial cable connector 100 may rely on press-fitting and friction-fitting forces and/or other component structures to help retain the post 40 in secure location both axially and rotationally relative to the connector body 50. The location proximate or otherwise near where the connector body 50 is secured relative to the post 40 may include surface features, such as ridges, grooves, protrusions, or knurling, which may enhance the secure location of the post 40 with respect to the connector body 50. Additionally, the post 40 includes a mating edge 46, which may be configured to make physical and electrical contact with a corresponding mating edge 26 of an interface port 20. The post 40 should be formed such that portions of a prepared coaxial cable 10 including the dielectric 16 and center conductor 18 can pass axially into the second end 42 and/or through a portion of the tube-like body of the post 40. Also, the post 40 should be dimensioned such that the post 40 may be inserted into an end of the prepared coaxial cable 10, around the dielectric 16 and under the protective outer jacket 12 and conductive grounding shield or strand 14. Accordingly, where an embodiment of the post 40 may be inserted into an end of the prepared coaxial cable 10 under the drawn or folded-back conductive strand 14, substantial physical and/or electrical contact with the strand layer 14 may be accomplished thereby facilitating grounding through the post 40. The post 40 may be formed of metals or other conductive materials that would facilitate a rigidly formed post body. In addition, the post 40 may be formed of a combination of both conductive and non-conductive materials. For example, a metal coating or layer may be applied to a polymer of other non-conductive material. Manufacture of the post 40 may include casting, extruding, cutting, turning, drilling, knurling, injection molding, spraying, blow molding, component over molding, or other fabrication methods that may provide efficient production of the component.

Figure 4:
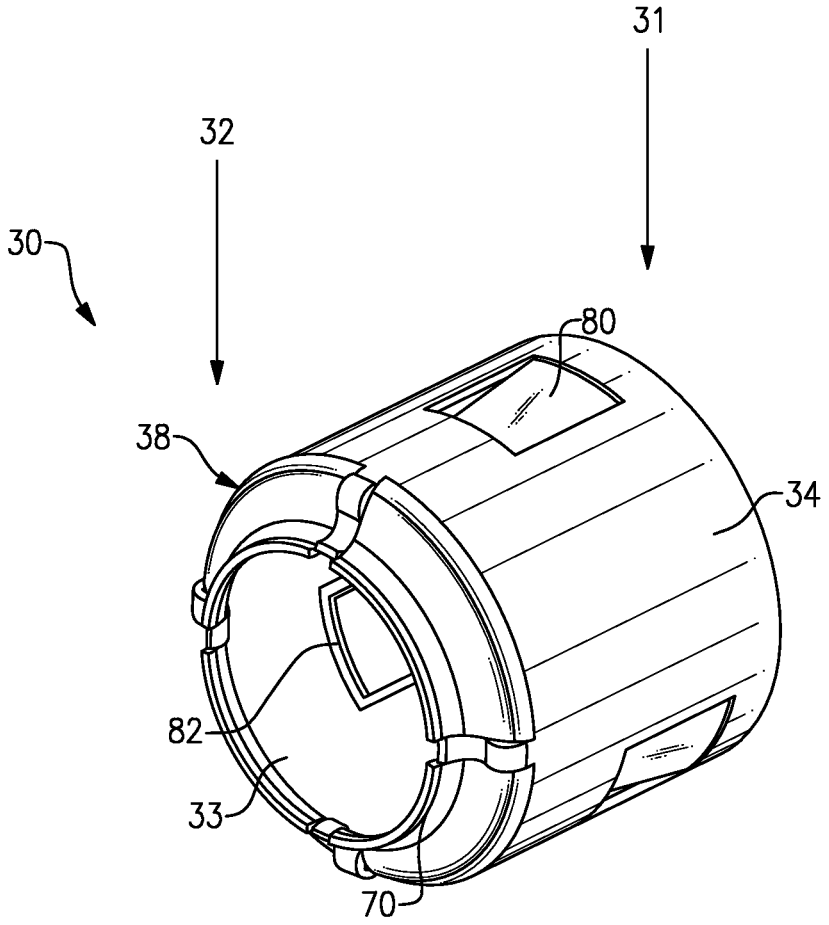
FIG. 4 depicts a perspective view of an embodiment of a coupling member.
Figure 5:
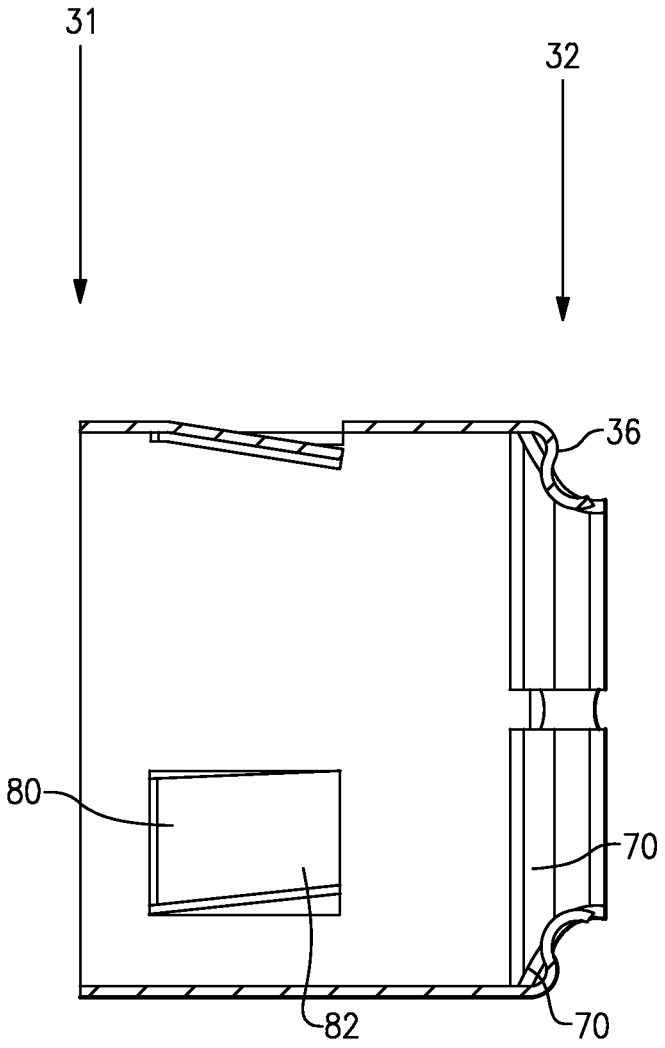
FIG. 5 depicts a first cross-sectional view of an embodiment of the coupling member.
Figure 6:
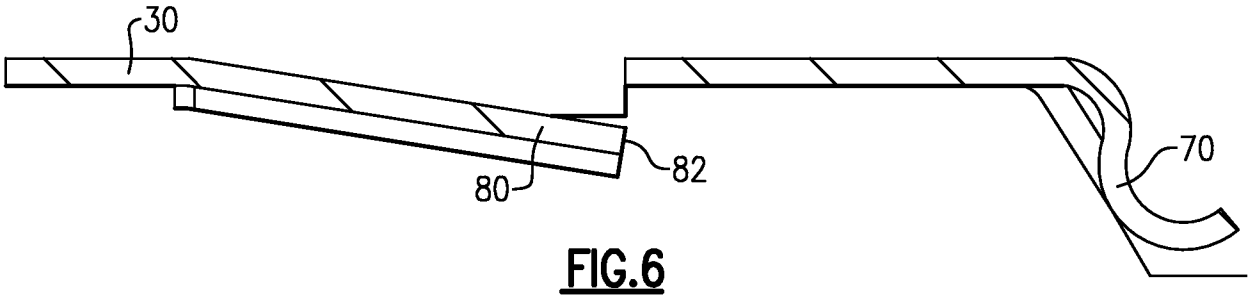
FIG. 6 depicts a second cross-sectional view of an embodiment of the coupling member.

With continued reference to FIGS. 1, 3 and 4, and further reference to FIGS. 4-6, embodiments of connector 100 may include a coupling member 30. The coupling member 30 may be a nut, a port coupling member, rotatable port coupling member, and the like, for various embodiments of a push-on connector, F-connector, cable connector (including triaxial and coaxial), and may be a coupling member for a device/connector that does not include a coaxial or triaxial cable. The coupling member 30 may include a first end 31, second end 32, an inner surface 33, and an outer surface 34. The inner surface 33 of the coupling member 30 may be a smooth, non-threaded surface to allow the coupling member 30 to be axially inserted over an interface port, such as port 20. However, the coupling member 30 may be rotatably secured to the post 40 to allow for rotational movement about the post 40. Embodiments of coupling member 30 may include a body 38 defined by an inner surface 33 and an outer surface 34 between a first end 31 and a second end 32, at least one resilient contact 80 extending a distance from the inner surface 33 of the body 38. The resilient contact 80 is configured to provide a retention force, and at least one resilient protrusion 70 extends a distance from the inner surface 33 of the body 38. The resilient protrusion 70 is proximate the second end 32 of the body 38 and is configured to contact a conductive surface of the post 40.

Embodiments of coupling member 30 may include a first set of contacts 70 for maintaining physical and electrical contact between the post 40 and the coupling member 30 to extend a RF shield and grounding path through the connector 100. Embodiments of the first set of contacts 70 may be structurally integral with the coupling member 30. Alternatively, the first set of contacts 70 may be integrally connected to a second set of contacts 80 through a conductive (e.g. metal) strip that can be embedded into the coupling member 30. The first set of contacts 70 may be located on/along an annular internal lip 36 proximate the second end 32 of the coupling member 30. The lip 36 may also be configured to hinder axial movement of the post 40. The first set of contacts 70 may be one or more resilient projections, bumps, and the like, that project and/or extend radially inward towards the outer surface 44 of the post 40 proximate or otherwise near the flange 45 of the post 40. For example, the first set of contacts 70 may physically and electrically contact the tapered surface 47 of the post 40 to maintain electrical continuity with the post 40 regardless of the advancement of the coupling member 30 onto a port 20 as a result of rotational motion. Embodiments of coupling member 30 may include a single contact 70 proximate the second end 32 of the coupling member 30, or may include a plurality of contacts 70 spaced apart from each other extending around or partially around the coupling member 30 proximate the second end 32. Thus, the locations, configurations, orientations, and the number of contacts 70 may vary, so long as at least one contact 70 physically engages (e.g. biases against) the post 40 to extend electrical continuity therebetween. The resilient nature of the contacts 70 (e.g. resilient protrusions, bumps, etc.) provide a biasing force against the rigid post 40 to establish constant contact between the post 40 and the contacts 70. For example, while operably configured (e.g. when the connector is fully advanced onto the port 20 and/or the connector 100 is in a compressed position), the resilient contacts 70 may come into contact with the post 40, and deflect slightly radially outward (back towards the coupling member 30), and due to the resiliency of the contacts 70, the contacts 70 can exert a constant biasing force in a radially inward direction against the post 40 to establish and maintain electrical continuity between the coupling member 30 and the post 40.

Figure 7:
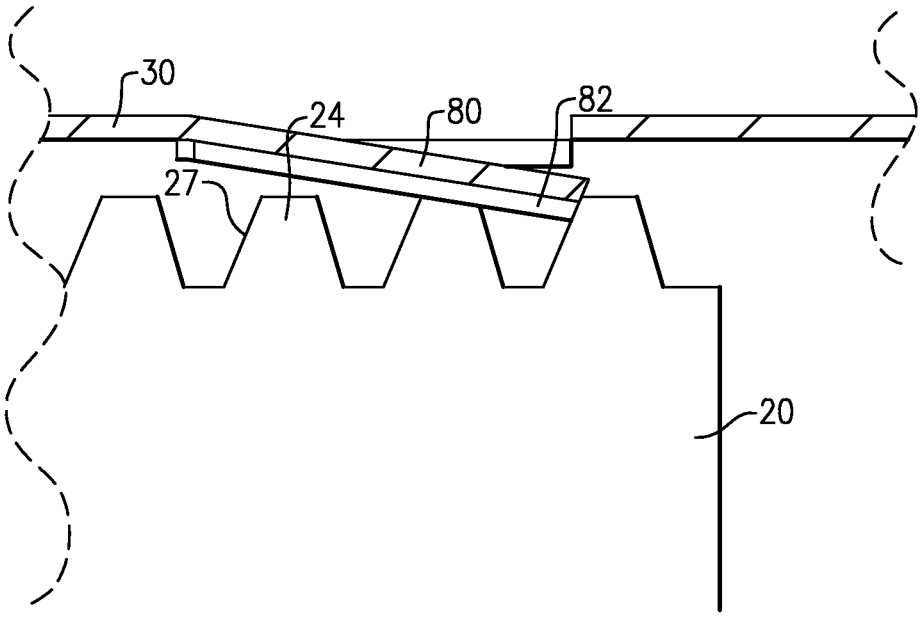
FIG. 7 depicts a cross-sectional view of an embodiment of a resilient contact having a tip engaged with a thread of a port.

Furthermore, in FIGS. 3-7, the coupling member 30 may include a second set of contacts 80 to provide a retention force between the coupling member 30 and the corresponding mating port 20. Embodiments of the second set of contacts 80 may be structurally integral with the coupling member 30. Alternatively, the second set of contacts 80 may be integrally connected to the first set of contacts 70 through a conductive (e.g. metal) strip embedded into the body 38 of the coupling member 30. The second set of contacts 80 may be located on/along/around the body 38 of the coupling member 30 at any point between the first end 31 and the lip 36 (FIG. 3) of the coupling member 30. The second set of contacts 80 may be resilient projections, prongs, fingers, or one-way latch fingers that project and/or extend radially inwards from an otherwise smooth inner surface 33 (FIG. 4) into the generally axial opening of the coupling member 30 and partially axially towards at least one of the first end 31 and the second end 32. Embodiments of the contacts 80 may be designed to pass over the threads 24 of the port 20 in a first axial direction (e.g. axially advancing the coupling member 30 onto the port 20), but may mechanically interfere with one or more threads 24 in a second axial direction (e.g. axially removing the coupling member 30 from the port 20). For instance, the second set of contacts 80 may be biased in a direction to allow the crests of the threads 24 of the port 20 to push the contacts 80 outward during forward axial movement of the coupling member 30 as the coupling member 30 is advanced onto the port 20, but which come to rest with the tips 82 of the contacts 80 lodged securely against the working surface 27 (FIG. 7) of the port threads 24, preventing the release of the connector 100 if pulled in an opposite axial direction, as shown in FIG. 7. The contact 80 and/or the tip 82 of the contact 80 may include a tapered or ramped surface design that may act as a ratcheting surface which allows the contacts 80 (or just the tips 82 to pass over the threads 24 in a first axial direction, but mechanically prevent motion in the second, opposite axial direction). Other embodiments of tip 82 may include a curved or rounded configuration to maximize or increase a retention force with a surface, such as working surface 27 (FIG. 7) of port 20. The engagement between the second set of contacts 80 and the threads 24 of the port 20 can provide a retention force between the connector 100 and the port 20 in an axial direction. To disengage the connector 100 from the port 20, a user may rotate/turn the coupling member 30 in a direction which loosens the coupling member 30 from the port 20. For example, rotating the coupling member 30 in a counter-clockwise direction may unthread the contacts 80 from the threads 24 of the port 20. Embodiments of coupling member 30 may include a single contact 80, or may include a plurality of contacts 80 spaced apart from each other extending around or partially around the coupling member 30 at various axial positions on the coupling member 30. Thus, the locations, configurations, orientations, and the number of contacts 80 may vary, so long as at least one contact 80 physically engages the port 20 when the coupling member 30 is advanced onto the port 20.

The coupling member 30, including the first and second set of contacts 70, 80, may be formed of conductive materials facilitating shielding/grounding through the coupling member 30. Accordingly the coupling member 30 may be configured to extend an electromagnetic buffer by electrically contacting conductive surfaces of an interface port 20 when a coaxial cable connector, such as connector 100, is advanced onto the port 20. In addition, the coupling member 30 may be formed of non-conductive material and function only to physically secure and advance a connector 100 onto an interface port 20. Also, the coupling member 30 may be formed of both conductive and non-conductive materials. In addition, the coupling member 30 may be formed of metals or polymers or other materials that would facilitate a rigidly formed body. Manufacture of the coupling member 30 may include casting, extruding, cutting, turning, tapping, drilling, injection molding, blow molding, or other fabrication methods that may provide efficient production of the component. Further embodiments of the coupling member 30 may be formed of plastic, or other non-conductive, non-metal material having a single (or more than one) conductive strip embedded into the body 38 of the coupling member 30. Thus, conductive materials need not completely surround the port 20; a conductive strip integrally connecting at least one resilient contact 80 and at least one resilient protrusion 70 may contact the surface of a port or a conductive surface (e.g. a post or other conductive surface of a cable connector). In other words, a strip of metal having at least one resilient contact 80 at one end and at least one resilient protrusion 70 at the other end may be embedded into an embodiment of a non-conductive, non-metal coupling member 30, wherein the conductive strip, particularly, the resilient contact(s) 80 and the resilient protrusion(s) 70, contact matably corresponding conductive surfaces to extend electrical continuity.

Referring to FIGS. 1 and 3-7, embodiments of a coaxial cable connector, such as connector 100, may include a connector body 50. The connector body 50 may include a first end 51, a second end 52, an inner surface 53, and an outer surface 54 (FIG. 3). Also, the connector body may include a post mounting portion 57 proximate or otherwise near the first end 51 of the body 50; the post mounting portion 57 configured to securely locate the body 50 relative to a portion of the outer surface 44 of post 40, so that the connector body 50 is axially secured with respect to the post 40, in a manner that prevents the two components from moving with respect to each other in a direction parallel to the axis of the connector 100. In addition, the connector body 50 may include an outer annular recess 56 located proximate or near the first end 51 of the connector body 50. Furthermore, the connector body 50 may include a semi-rigid, yet compliant outer surface 54, wherein the outer surface 54 may be configured to form an annular seal when the second end 52 deformably compresses a received coaxial cable 10 by operation of a fastener member 60. The connector body 50 may include an external annular detent 58 located along the outer surface 54 of the connector body 50. Further still, the connector body 50 may include internal surface features 59, such as annular serrations formed near or proximate the internal surface of the second end 52 of the connector body 50 and configured to enhance frictional restraint and gripping of a coaxial cable 10, through tooth-like interaction with the cable. The connector body 50 may be formed of materials such as plastics, polymers, bendable metals or composite materials that facilitate a semi-rigid, yet compliant outer surface 54. Further, the connector body 50 may be formed of conductive or non-conductive materials or a combination thereof. Manufacture of the connector body 50 may include casting, extruding, cutting, turning, drilling, knurling, injection molding, spraying, blow molding, component over-molding, combinations thereof, or other fabrication methods that may provide efficient production of the component.

Still referring to FIGS. 1 and 3-7, embodiments of a coaxial cable connector 100 may include a fastener member 60. The fastener member 60 may have a first end 61, second end 62, inner surface 63, and outer surface 64. In addition, the fastener member 60 may include an internal annular protrusion located proximate the first end 61 of the fastener member 60 and configured to mate and achieve purchase with the annular detent 58 on the outer surface 54 of connector body 50. Also, the fastener member 60 may comprise a central passageway or generally axial opening defined between the first end 61 and second end 62 and extending axially through the fastener member 60. The central passageway may include a ramped surface 66 which may be positioned between a first opening or inner bore having a first inner diameter positioned proximate or otherwise near the second end 62 of the fastener member 60 and a second opening or inner bore having a larger, second inner diameter positioned proximate or otherwise near the first end 61 of the fastener member 60. The ramped surface 66 may act to deformably compress the outer surface 54 of the connector body 50 when the fastener member 60 is operated to secure a coaxial cable 10. For example, the tapered geometry will compress against the cable, when the fastener member 60 is compressed and tightly secured against the connector body 50. Additionally, the fastener member 60 may comprise an exterior surface positioned proximate to the second end 62 of the fastener member 60. The surface may facilitate gripping of the fastener member 60 during operation of the connector 100. Although the surface is shown as an annular detent, it may have various shapes and sizes such as a ridge, notch, protrusion, knurling, or other friction or gripping type arrangements. The first end 61 of the fastener member 60 may extend an axial distance so that, when the fastener member 60 is compressed into sealing position on the coaxial cable 100, the fastener member 60 touches or resides substantially proximate to the coupling member 30. It should be recognized, by those skilled in the requisite art, that the fastener member 60 may be formed of rigid materials such as metals, hard plastics, polymers, composites and the like, and/or combinations thereof. Furthermore, the fastener member 60 may be manufactured via casting, extruding, cutting, turning, drilling, knurling, injection molding, spraying, blow molding, component over-molding, combinations thereof, or other fabrication methods that may provide efficient production of the component.

Figure 8:
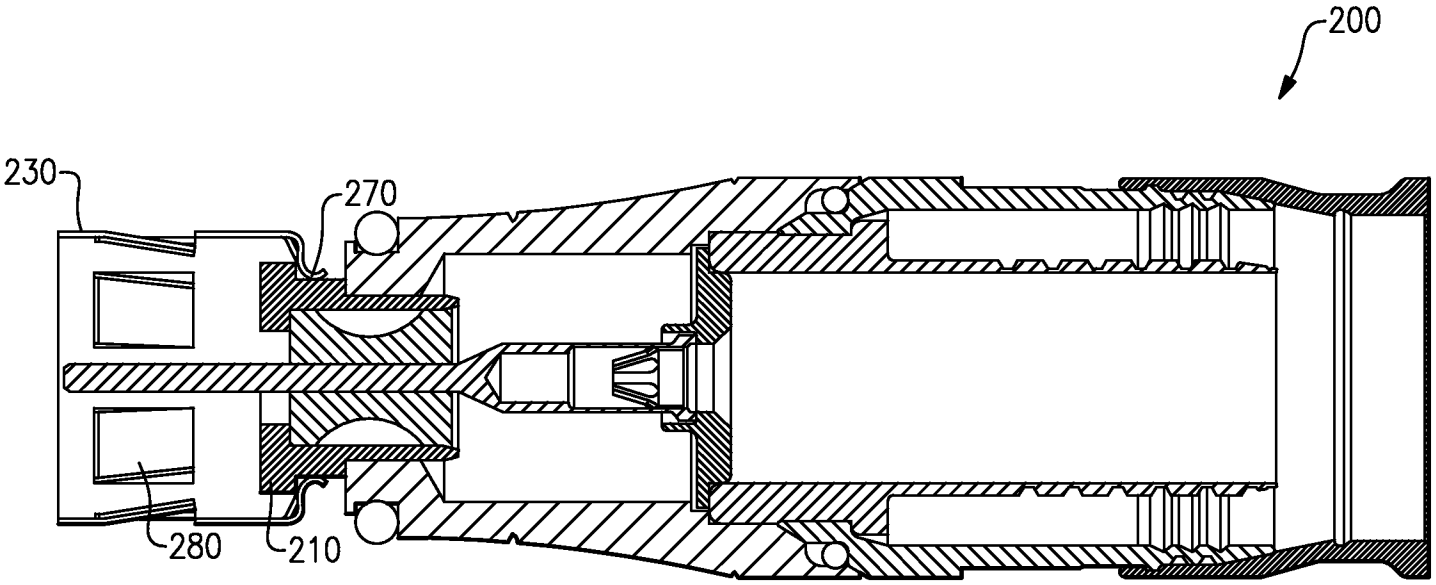
FIG. 8 depicts a cross-sectional view of a second embodiment of a coaxial cable connector.
Figure 9:
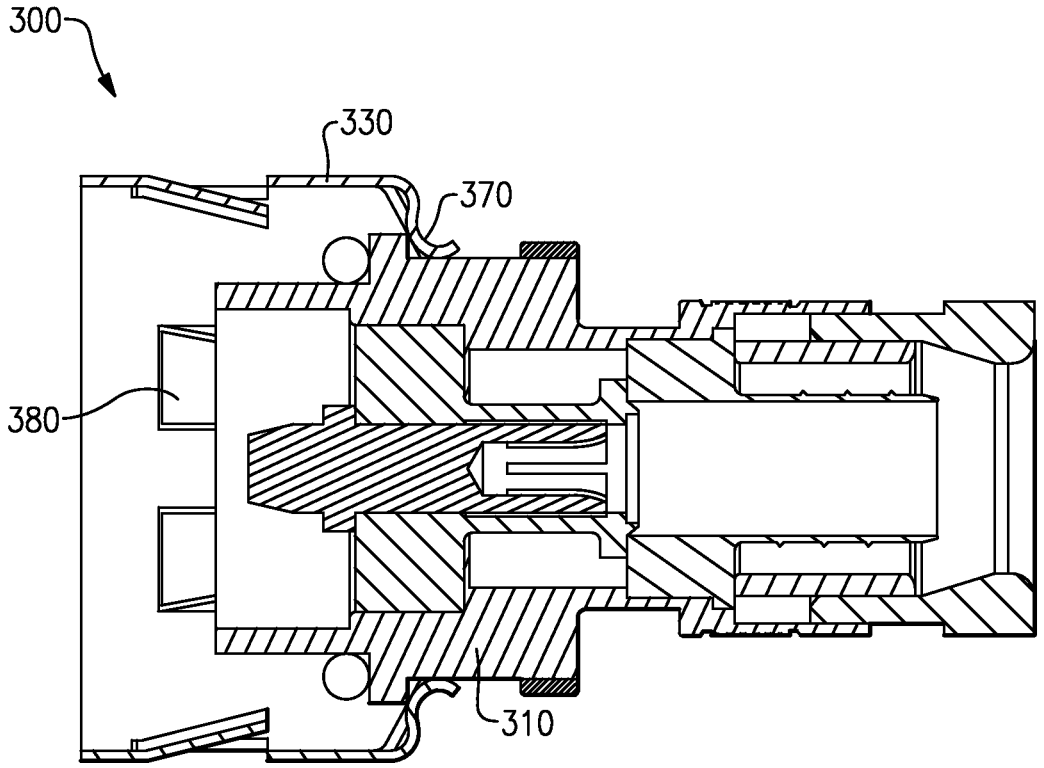
FIG. 9 depicts a cross-sectional view of a third embodiment of a coaxial cable connector.
Figure 10:
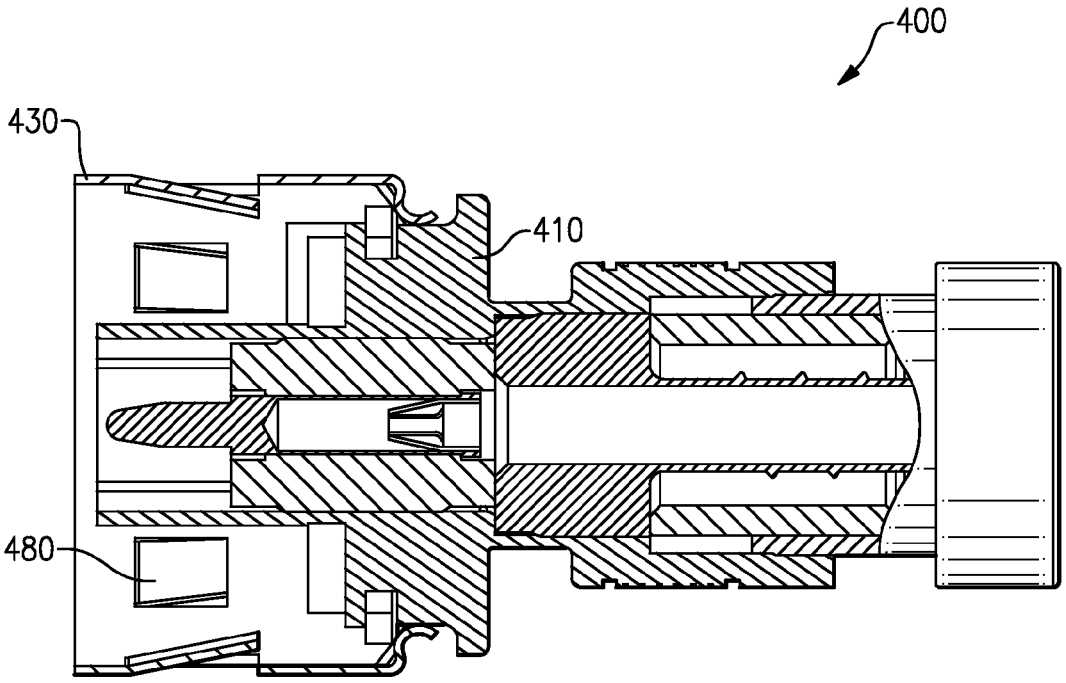
FIG. 10 depicts a cross-sectional view of a fourth embodiment of a coaxial cable connector.

Referring now to FIGS. 8-10, coaxial cable connectors other than a feed-through type connector, such as an F connector, can include a coupling member 230, 330, 430 that provides a retention force to prevent disengagement from a port 20 while also extending electrical continuity through the connector 200, 300 without contacting a post 40, or a component making direct contact with a port 20 that also is in physical contact with a prepared end of a coaxial cable 10. For example, embodiments of connectors 200, 300, 400 may include a coupling member 230, 330, 430 having a first set of contacts 270, 370, 470 to resiliently contact a conductive component 210, 310, 410 and a second set of contacts 280, 380, 480 configured to provide a retention force in an axial direction between the coupling member and the port 20 (as described above). The conductive component 210, 310, 410, contacts the surface of the port 20 but does not physically contact a prepared end of a coaxial cable 10 (e.g. the dielectric 16 or, outer conductive strand layer 14). Embodiments of coupling member 230, 330, 430 that may share the same or substantially the same structural and functional aspects of coupling member 30. However, coupling member 230, 330, 430 may be axially rotatable with respect to a conductive member 210, 310, 410 such that the coupling member 230, 330, 430 may freely rotate about at least the conductive member 210, 310, 410.

Figure 11A:
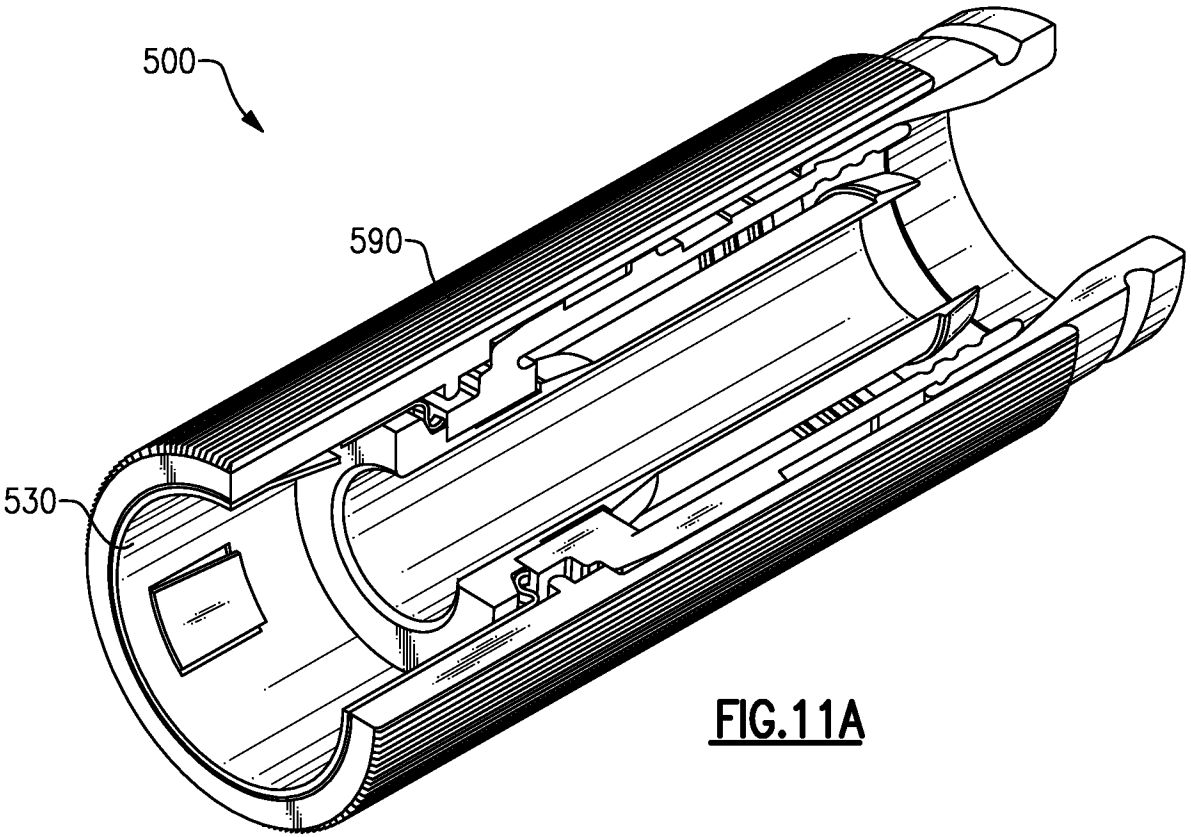
FIG. 11A depicts a perspective view of an embodiment of a fifth embodiment of a coaxial cable connector.
Figure 11B:
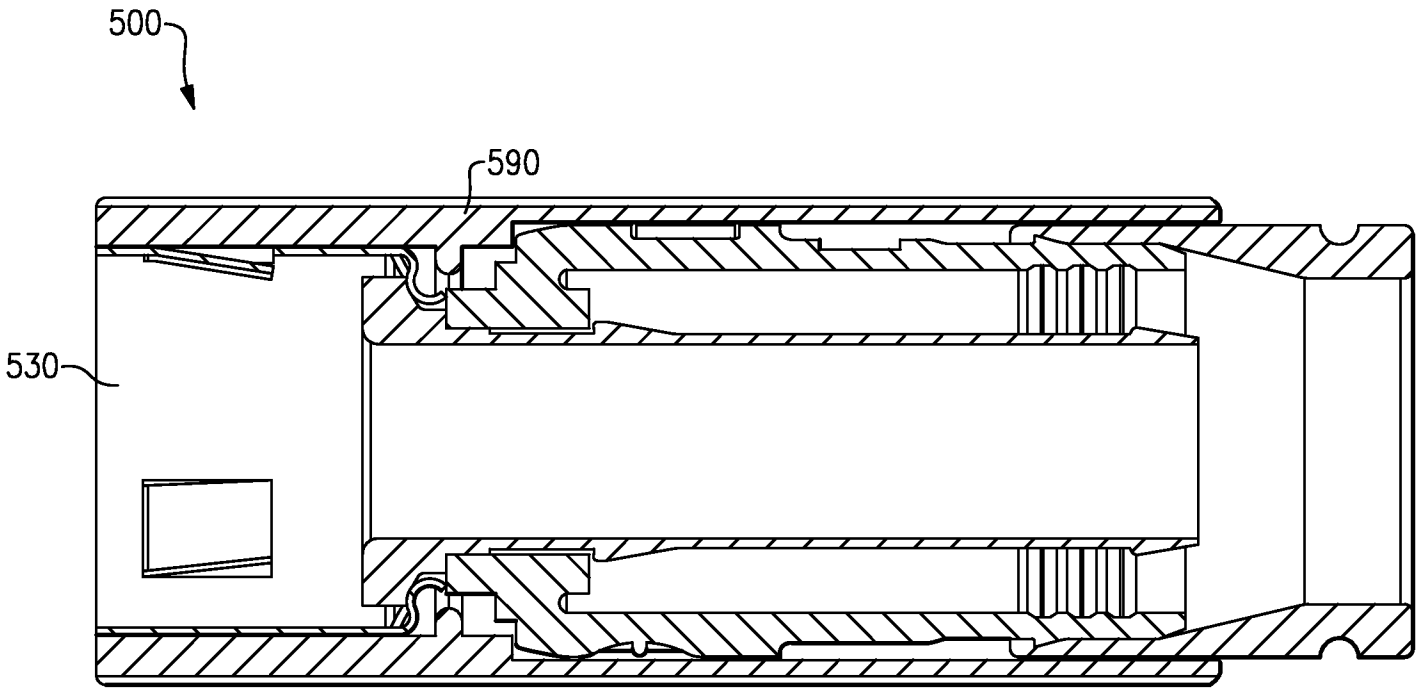
FIG. 11B depicts a cross-section view of an embodiment of the fifth embodiment of a coaxial cable connector.

With continued reference to the drawings, FIGS. 11A and 11B depict an embodiment of connector 500 including a coupling member 530 and an outer sleeve 590. Embodiments of coupling member 530 may share the same or substantially the same structure and function as the coupling member 30. However, embodiments of coupling member 530 may be configured to mate with an outer sleeve 590. The coupling member 530 may have an annular groove or surface feature that cooperates with a groove or surface feature of the sleeve 590 to operably connect the outer sleeve 590 with the coupling member 530. Alternatively, the two components 530, 590 may be press-fit or rely on an interference fit to operably connect the components. The connection between the coupling member 530 and outer sleeve 590 results in rotation or twisting of the coupling member 530, which can assist a user when rotating the coupling member 530 in a reverse direction to disengage the port 20. Further, the outer sleeve 590 may have outer surface features to facilitate gripping of the outer sleeve 590.

Referring to FIG. 1-12, a method of retaining a connector 100 onto a port 20 in an axial direction, may include the steps of: (i) providing a post 40 configured to receive a center conductor 18 surrounded by a dielectric 16 of a coaxial cable 10, a connector body 50 attached to the post 40, a coupling member 30 attached to the post 40, wherein the coupling member 30 has a first end 31 and second end 32, and (ii) forming one or more resilient contacts 80 on the coupling member 30, wherein the resilient contacts 80 are configured to pass over the external threads 24 in a first axial direction, and physically engage the external threads 24 in a second axial direction. The method may further include the step of: (i) facilitating continuity through the coaxial cable connector 100 by forming one or more resilient protrusions 70 proximate the second end 32 of the coupling member 30, which resilient protrusions 70 are configured to physically and electrically contact the post 40.

Coaxial Port Accessory and Integrated Interface Port

Figure 13:
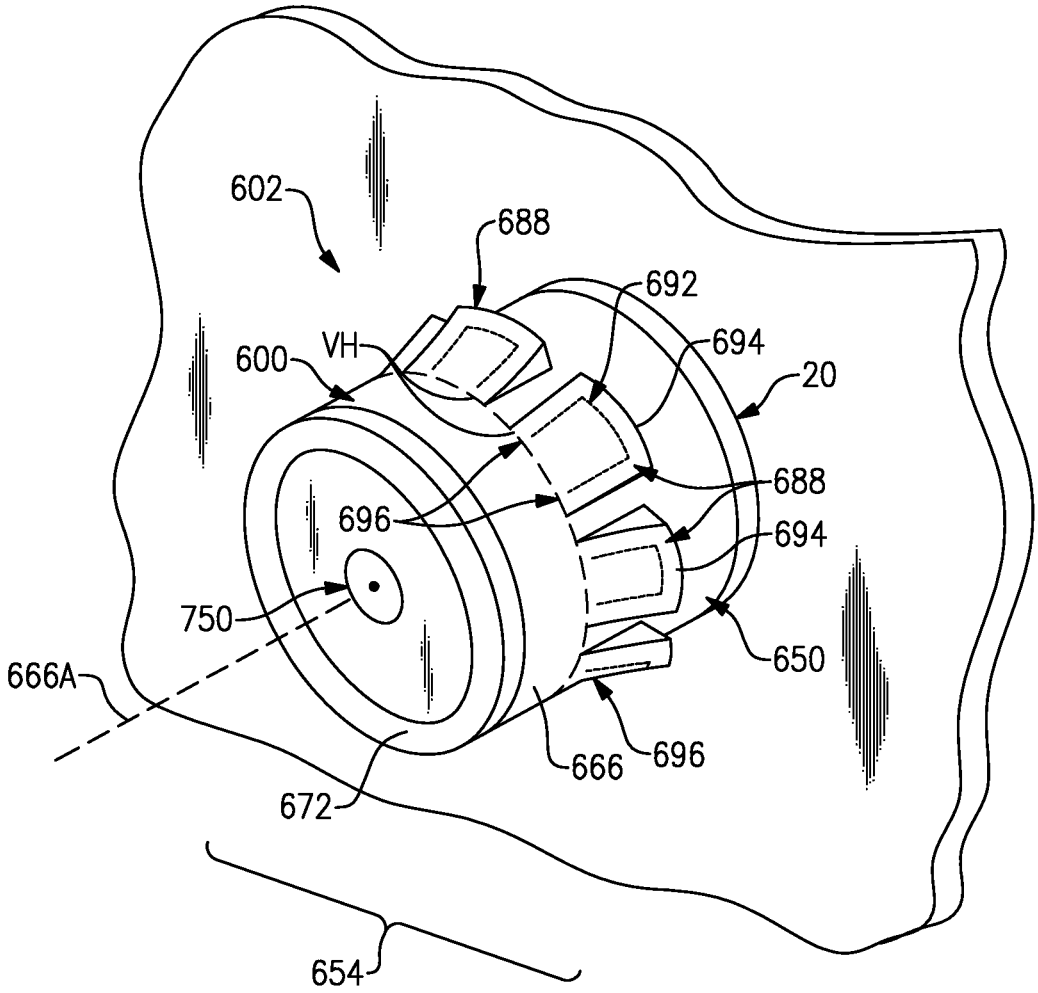
FIG. 13 depicts an isometric view of an embodiment of a coaxial port accessory and an integrated interface port for connecting a coaxial cable to an RF device wherein the coaxial port accessory and integrated interface port are configured to axially engage and rotationally disengage an internally threaded connector of a coaxial cable.
Figure 14:
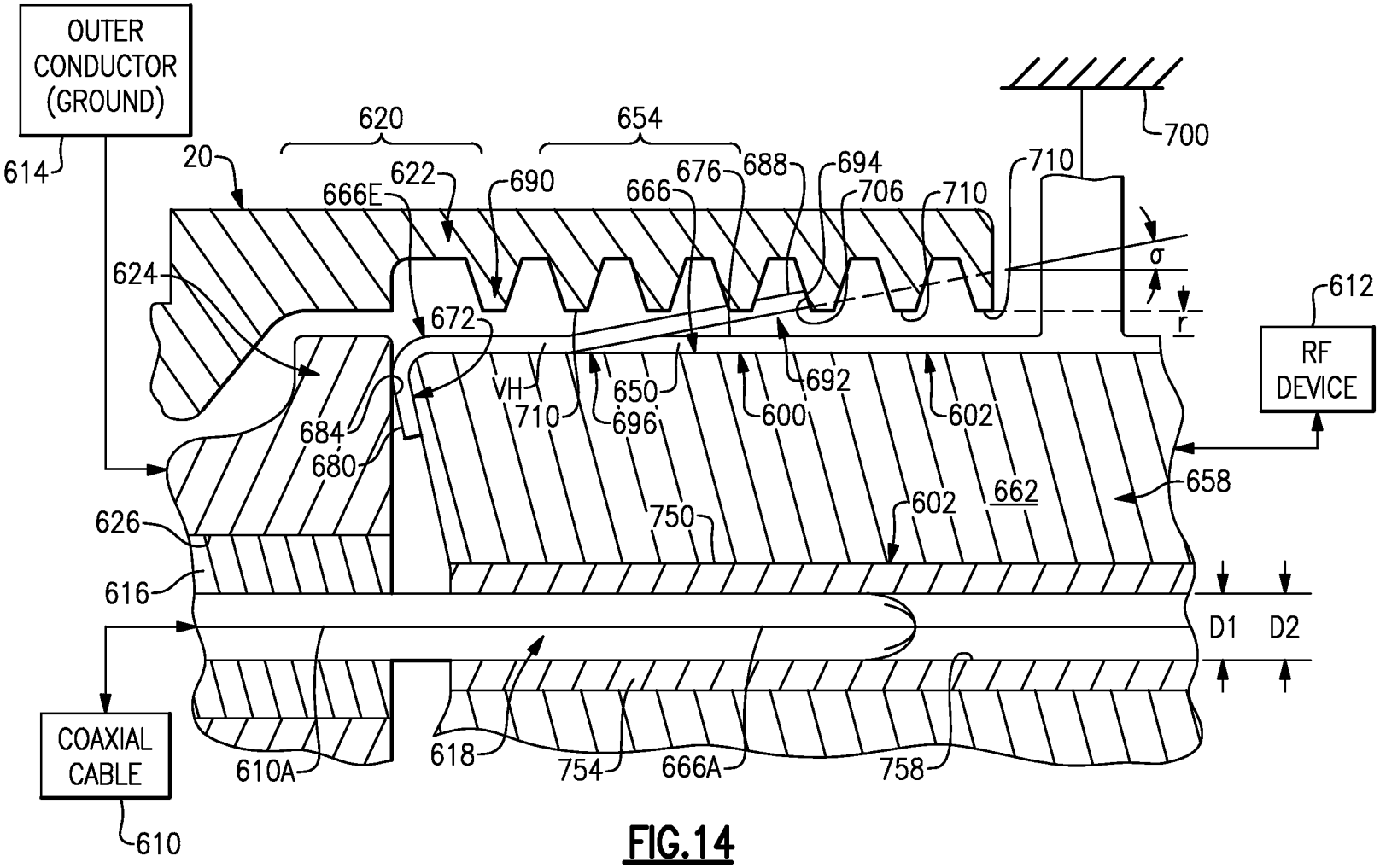
FIG. 14 depicts an enlarged cross-sectional view of one embodiment of the integrated interface port including a first conductor portion electrically connected to an outer conductor of the coaxial cable connector, and a second conductor portion electrically connected to an inner conductor of the coaxial cable connector.
Figure 19:
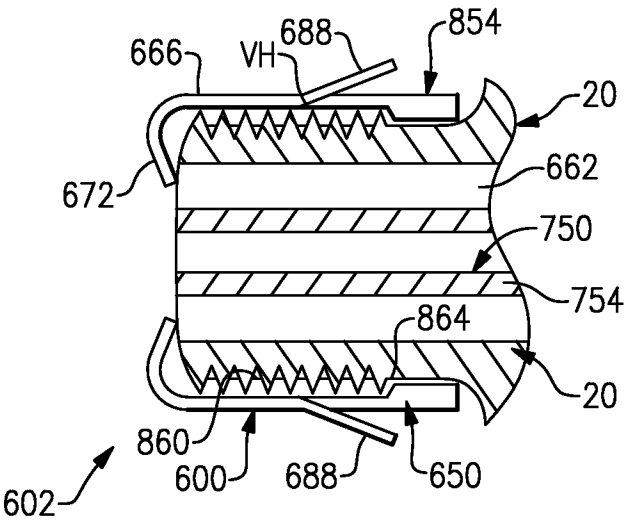
FIG. 19 depicts a sectional view of one of the integrated input and output ports wherein the coaxial port accessory slides onto, and frictionally/threadably engages the outer threaded body of a conventional RF interface port.

In the embodiments illustrated in FIGS. 13, 14 and 19, a coaxial port adapter, coaxial port converter, coaxial interface accessory, coaxial slide-on attachment, coaxial interface port device or coaxial port accessory 600 provides a reliable connection between a coaxial cable 610 and an RF device. Such RF devices 612 and 812 are shown in FIGS. 14 and 19, respectively. The coaxial port accessory 600 is configured to be slid, pressed, screwed, welded, soldered, or otherwise integrated over, or into, a coaxial interface port, such as the port 20, shown in FIG. 3. As such, the coaxial port device or accessory 600 changes, modifies, or alters the port to produce an integrated coaxial interface port 602. The port device or accessory 600 may be manufactured and/or integrated with the dielectric core and inner conductor of a conventional interface port to produce the integrated port 602 for the RF device 612 shown in FIG. 14. Alternatively, the port accessory 600 may be attached to a fully-functional, interface port, e.g., a threaded or smooth-surface port, to produce the integrated interface port 602 for the RF device 812 shown in FIG. 19.

The coaxial cable 610 may be connected to the integrated port 602 by any one of a variety of cable connectors, however, in the embodiments described herein, an internally-threaded coaxial cable connector 620 is employed to effectuate a connection between the coaxial cable 610 and the integrated port 602.

Before describing the port device or accessory 600 or integrated port 602 in greater detail, it will be useful to acknowledge several similarities between the structural elements of the connector 100 described in the previous section of the Detailed Description and the port accessory 600 and the integrated port 602. For example, it should be appreciated that the port accessory 600 is functionally analogous to the conductive strand layer 14 of the coaxial cable 10 described supra. Additionally, a signal-carrying or conductive lead 618 of the integrated port 602 is similarly analogous to the center conductive strand 18 of the coaxial cable 10 described above. Other components of the port accessory 600 and integrated port 602, such as, for example, a resilient contact 688 (described in greater detail hereinafter) have some of the same structural and functional features as the resilient contact 80 of the connector 100. It will be appreciated, however, that the resilient contact 688 has many different structural features providing a wide variety of functions in connection with the port accessory 600 or integrated interface port 602. These features will be discussed in greater detail hereinafter.

Additionally, the coaxial cable connector 620 comprises, inter alia, an internally-threaded coupler 622 and a conductive post 624 for electrically connecting the outer conductor 614 to the port accessory 600 or to the integrated coaxial interface port 602. The central post 624, furthermore, defines a central bore or aperture 626 for receiving and supporting a portion of the coaxial cable 610 including: (i) the inner conductor or conductive lead 618, and (ii) an insulating dielectric core 616 disposed between the conductive lead 618 and the conductive central post 624.

The port accessory 600 is configured to: (i) electrically communicate with the outer conductor 614 of the coaxial cable 610, (ii) axially engage a threaded coupler 622 of a coaxial cable connector 620 and (iii) rotationally disengage the threaded coupler 622 of a coaxial cable connector 620. The integrated port 602 are additionally configured to electrically communicate with the inner conductor 618 of the coaxial cable 610.

The port accessory 600 may be viewed as a first conductor portion 650 of an interface port having first and second conductors 650, 750. Furthermore, the port accessory 600 may be viewed as one of the components comprising the integrated interface port 602. Finally, the port accessory 600 may be viewed as a separate, stand-alone, or detachable component which may be integrated with other components, e.g., a dielectric core and an inner conductor, to comprise the integrated port 602. Hence, when referring to the port accessory 600 as an integral part of the integrated interface port 602, the port accessory 600 is the first conductor portion 650. When referring to the port accessory 600 as a separate, stand-alone, detachable component, the port accessory 600 is only a portion, or part, of the integrated port 602. The relationship of the port accessory 600 to the integrated interface port 602 will become clear in view of the following detailed description.

The port accessory 600 comprises a conductive outer shell or body 654 defining an inner cavity 658 for receiving the second conductor portion 750. More specifically, the inner cavity 658 of the outer body 654 receives a dielectric inner core 662, which is centered about and receives the second conductor portion 750. Also, the dielectric inner core 662 is disposed between and electrically insulates the second conductor portion 750 from the first conductor portion 650. The conductive outer body 654 may be bonded to, or press-fit over, the dielectric inner core 662. In other embodiments, the conductive outer body 654 may slide over and frictionally/threadably engage an outer body of an interface port. For example, the outer body 654 can have internal threads with a nylon insert, suitable for screwing and locking onto an F-type interface port. One such embodiment is described in connection with an in-line RF device shown in FIGS. 18 and 19.

The conductive outer body 654 comprises a substantially cylindrically-shaped periphery 666 and an annular rim 672 extending from a forward end 666E of the outer periphery 666. The outer periphery 666 also defines a conductive outer surface 676 and an elongate axis 666A which is substantially coaxial with the axis 610A of the coaxial cable 610. The annular rim 672 extends radially inward from the forward end 666E of the outer periphery 666 toward the elongate axis 666A. Further, the annular rim 672 includes a conductive front face 680 which opposes an annular surface 684 of the conductive post 624. As will be discussed when describing the assembly and disassembly of the coaxial cable connector 620, the front face 680 of the annular rim 672 engages the annular surface 684 of the post 624 to electrically couple the outer conductor 614 to the first conductor portion 650 of the integrated port 602.

The conductive outer periphery 666 includes at least one flexible, resilient tab or contact 688 having a tip or free end 692 extending a radial distance from the conductive outer surface 676 of the outer periphery 666. Furthermore, the free end 692 of each resilient tab or contact 688 is radially outboard or further away from the elongate axis 666A than a connected or integrating end 696 of the body 654. While the resilient contact or tab 688 of the first conductor portion 650 is structurally similar to the resilient contact 80 of the connector 100, there are structural differences which should be borne in mind due to the integration of the resilient tab contact 688 with the integrated interface port 602. Each tab or contact 688 has a spring characteristic and is predisposed to have a outward position. As described below, the contacts 688 are moveable to an inward position when the connector 100 applies a radial inward force to the contacts 688 during the slide-on installation.

In the described embodiment, a plurality of resilient contacts 688 are arranged in equiangular increments about the conductive outer surface 676 of the outer periphery 666. Each resilient contact 688 is integrally formed with the outer body 654 such that a virtual or effective hinge VH is produced at the connected or integrating end 696 of the respective resilient contact 688, i.e., opposite the tip end 692 thereof. The effective hinge VH is operative to bias the tip or free end 692 of each resilient contact 688 in a radial outward direction, away from the conductive outer surface 676. The spring force applied by the effective hinge VH is a function of the modulus (M) of the conductive material used to fabricate the outer body 654, the wall thickness (t) of the conductive outer periphery 666, and the area moment of inertia $I_A$ of the cross-sectional area.

In FIG. 14, the resilient tabs or contacts 688 are inclined relative to the elongate axis 666A such that each contact 688 is configured to engage a working or threaded profile surface 706 of the threaded coupler 622, i.e., a surface 706 which complements the tip or free end 692 of the contact 688. In one embodiment, the working or threaded profile surface 706 includes the inner threaded surface of the coupler or nut of an F-type coaxial cable connector. In the described embodiment, each resilient contact 688, may define an angle θ ranging from between approximately three) (3°) degrees to approximately (10°) degrees relative to the axis 666A. The angle θ may vary depending upon the pitch, or distance between consecutive peaks, (i.e., the top land surfaces 710 of consecutive spiral threads 690. More specifically, as the pitch, or distance between top land surfaces 710 increases, the angle θ available to access a working surface 706 of a spiral thread 690 increases, i.e., provided that the radial distance (r) or spacing between the integrated port 602 and the threaded coupler 622 remains unchanged.

Figure 15:
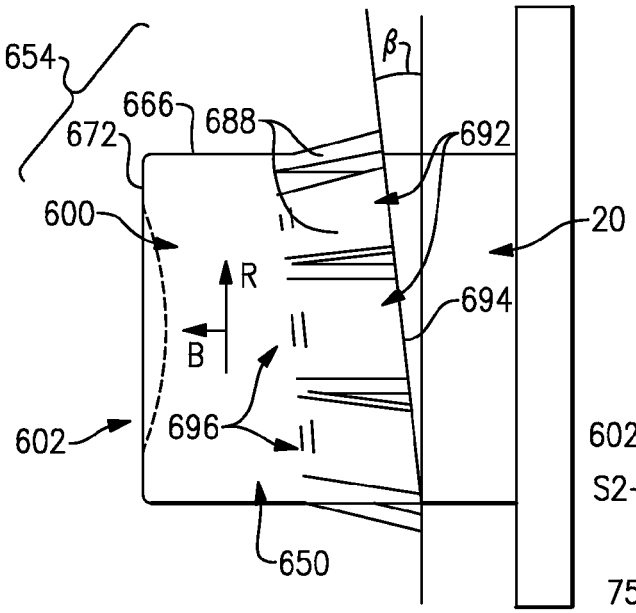
FIG. 15 depicts a side profile view of one embodiment of the coaxial port accessory and integrated interface port including a plurality of flexible tabs or resilient contacts, each having a sloping or inclined edge operative to engage a working or threaded surface of a threaded coupler of the coaxial cable connector.

In FIGS. 14 and 15, the tip or free end 692 of each contact 688 defines an angle β corresponding to the helix or lead angle of a respective thread 690 of the threaded coupler 622. The helix or lead angle β corresponds to the axial distance that a spiral thread 690 moves in one revolution. Stated in the alternative, the lead angle β corresponds to the axial distance that an object travels when sliding along the working or threaded profile surface 706 of a stationary thread 690. The angled edges 694 of the resilient contacts 688 are machined, cut or fabricated to correspond to the lead angle β such that when the threaded coupler 622 rotates about axis 666A in a direction R, the thread 690 engaging the plurality of contacts 688 causes the angled edges 694 to slide along the working surface 706. As each tip or free end 692 slides along the working surface 706, the threaded coupler 622 disengages the integrated interface port 602 in the direction of arrow B.

Figure 16:
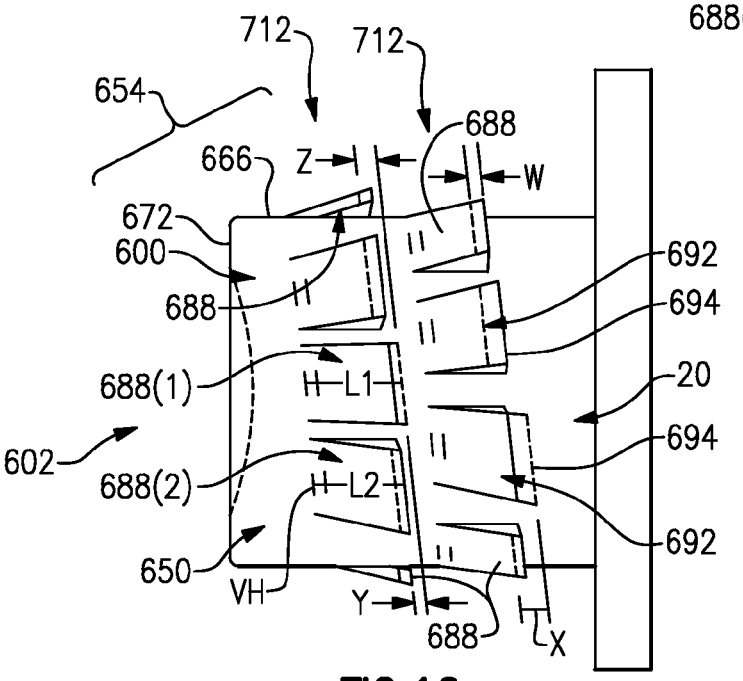
FIG. 16 depicts a side profile view of one embodiment of the coaxial port accessory and integrated interface port including a plurality of flexible tabs or resilient contacts wherein the axial length of the each resilient contact varies from one resilient contact to another.

In another embodiment, shown FIGS. 14 and 16, the integrated interface port 602 may include two or more rows of contacts 712 arranged in tandem. While the resilient contacts 688 are shown to be axially aligned, it will be appreciated that the resilient contacts 688 may be circumferentially staggered or randomly-spaced from one resilient contact to another.

Furthermore, the tip or free end 692 of each contact 688 may be variably displaced in an axial direction relative to the elongate axis 666A to ensure that at least one of the resilient contacts 688 engages a working surface 706 of the threaded coupler 622. This embodiment addresses issues associated with manufacturing deviations which may prevent a contact 688 from engaging a working surface of the threaded coupler 622. In this embodiment, one of the tabs or contacts 688(1) may be axially longer or shorter than an adjacent tab or contact 688(2), e.g., by distances W, X, Y, and Z. More specifically, the axial length L1 of one resilient contact 688(1), measured from the free end 692 to the connected end 696, is different, i.e., longer or shorter, than the axial length L2 of another resilient tab 688(2). As a result, some of the tabs may "hang-up" on a land surface 710 while others are sufficiently long or short to engage the working or thread profile surface 706 of the threaded coupler 622. That is, at least one of the contacts 688 will be sufficiently long or short to engage a working surface 706 and release the threaded coupler 622, in response to rotation of the coupler 622, i.e., as the coupler slides along the surface 706.

Figure 17:
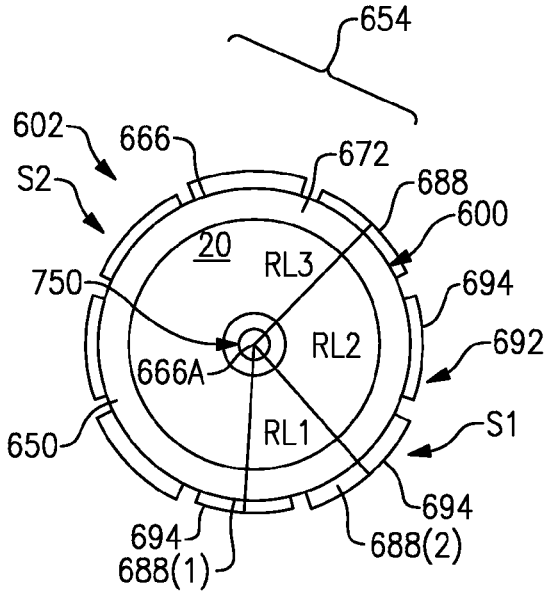
FIG. 17 depicts a top view of one embodiment of the coaxial port accessory and integrated interface port including a plurality of flexible tabs or resilient contacts wherein the edge radius of each resilient contact varies from one resilient contact to another.

In another embodiment shown in FIGS. 14 and 17, the tip or free end 692 of each contact 688 may be variably displaced in an radial direction, i.e., forward or away from the elongate axis 666A. In this embodiment, the radial edge 692 of one contact or tab 688(1) extends a radial length RL1 from the axis 666A which may be greater than or less than the radial length RL2 of an adjacent contact 688(2). Stated another way, the radial length RL1 of one resilient tab or contact 688(1) is different than the radial length RL2 of an another resilient tab 688(2). When viewed from the top view of FIG. 17, the radial contacts 688 form a circumferential edge which extends laterally relative to elongate axis 666A. As will be discussed in greater detail below, the random radial displacement from one side S1 of the integrated interface port 602 to another side S2, ensures that grounding contact will be maintained should an external force laterally displace the connector 620.

During assembly, an operator slides or pushes an internally-threaded connector 620 over the conductive outer body 654 of the integrated interface port 602, i.e., over the annular rim 672 and the conductive outer periphery 666. As the connector 620 slides over the outer body 654, the top land surfaces 710 of each spiral thread or tooth 690 depress each depressible, resilient contact 688 radially inward toward the elongate axis 666A. Upon reaching a predetermined axial position, the angled edges 694 spring back, i.e., in response to the forces applied by the preloaded effective hinge VH, to engage a working or threaded profile surface 706 of the threaded coupler 622. In the described embodiment, the working surface 706 is the thread profile surface on one side of a spiral thread 690. Inasmuch as the angled edges 694 are fabricated to complement the lead or helix angle β of a spiral thread 690, the angled edge 694 of at least one resilient contact 688 will match or complement an opposing portion of the threaded profile surface 706.

The connector 620 is fully-engaged when the face surface 684 of the post 624 abuts the front face 680 of the annular rim 672, thereby stopping any further axial displacement. Rearward displacement, or displacement of the connector 620 away from the integrated interface port 602, or away from the RF device 612, is inhibited or retarded as the working surface 706 contacts the angled edges 694 of each resilient contact 688. As mentioned above, the axial length L1 of one resilient contact 688(1) may be longer or shorter than the axial length L2 of another resilient contact 688(2). The axial length may be measured from the effective hinge VH to the end or edge 692 of the resilient contact 688. In the described embodiment, the axial length L2 of resilient contact 688(2) is greater than the axial length L1 of resilient contact 688(1) by a difference Y. Depending upon the pitch of the threads 690, one of the resilient contacts 688 may lay on a top land 710, while the other may engage the working surface 690. As a result, at least one of the of the resilient contacts 688A will be correctly sized to properly engage the working surface 690.

In another embodiment shown in FIGS. 14 and 17, the tip end or edge 692 of each contact 688 may be variably displaced in an radial direction, i.e., toward or away from the elongate axis 666A. In this embodiment, the radial edge 692 of one contact 688A extends a radial length RL1 from the axis 666A which may be greater than or less than the radial length RL2 of an adjacent contact 688(2). When viewed from the top view of FIG. 17, the radial contacts 688 form a circumferential edge which extends laterally relative to elongate axis 666A. The random radial displacement from one side S1 of the integrated interface port 602 to another side S2, ensures that grounding contact will be maintained should an externally applied force displace the connector 620 in a lateral direction.

In this position, the first conductor portion 650 of the integrated interface port 602, which includes: (i) the annular rim 672, (ii) the conductive outer periphery 666, and (iii) the resilient contacts 688, is disposed in grounding contact with the outer conductor 614 of the coaxial cable 610. That is, the outer conductor 614 is in electrical contact with the post 624 which, in turn, electrically contacts the annular front face 680 of the rim 672. The annular rim 672, furthermore, is electrically coupled to a ground source 700 via the conductive outer periphery 666. While the first conductor portion 650 provides a primary path to ground 700, other paths may be produced to provide electrical protection from a lightning strike, electrical surge, or stray electrical signals causing interference.

As the threaded connector 620 slides over the outer body 654 of the integrated interface port 602, the second conductor portion 750 receives the inner conductor or conductive lead 618 of the connector 620. More specifically, the second conductor portion 750, which comprises an inner conductor sleeve or engager 754, is axially received by an aperture or orifice 758 defined by the engager 754. The engager 754 is electrically coupled to the RF device 612 such that RF signals may be transmitted between the RF device 612 and the coaxial cable 610, which, in turn, is transmitted to/from a head-end facility of a service provider. While the inner conductor engager 754 is shown as including a cylindrical sleeve or tube having a diameter D1 which is substantially equal to the diameter D2 of the conductive lead 618, it will be appreciated that the conductor engager 754 may define a smaller diameter to increase the friction force between the engager 754 and the outer conductor or lead 618. For example, the engager 754 may comprise a plurality of arcuate fingers (not shown) defining a decreased diameter region capable of frictionally engaging the peripheral surface of the outer conductor 618. Therefore, in addition to providing an electrical conduit for the transmission of data and information, the engager 754 may contribute to the retention forces acting to couple the cable to the integrated interface port 602.

Disassembly of the threaded connector 620 involves counterclockwise rotation, or unscrewing, of the coupler 622 relative to the integrated interface port 602 about the elongate axis 666A. In FIG. 15, as the connector 620 rotates in a direction R, the angled edges 694 of the resilient contacts 688 are caused to engage the working surface 706 of the threaded connector 620, i.e., by applying a rearward axial force as the threaded connector 620 is rotated. When the angled edges 694 of the resilient contacts 688 have rotationally disengaged the working surface 706, the inner and outer conductors 614, 618 of the coaxial cable 610 are axially separated from the first and second conductive portions 650, 750 of the integrated interface port 602. While axial separation of the outer conductor 614 merely requires physical separation of the front face 680 and 684 of the annular rim 672 and post 624, respectively, axial separation of the conductive lead 618 requires removal of the conductive lead 618 from the conductive engager 754.

Figure 18:
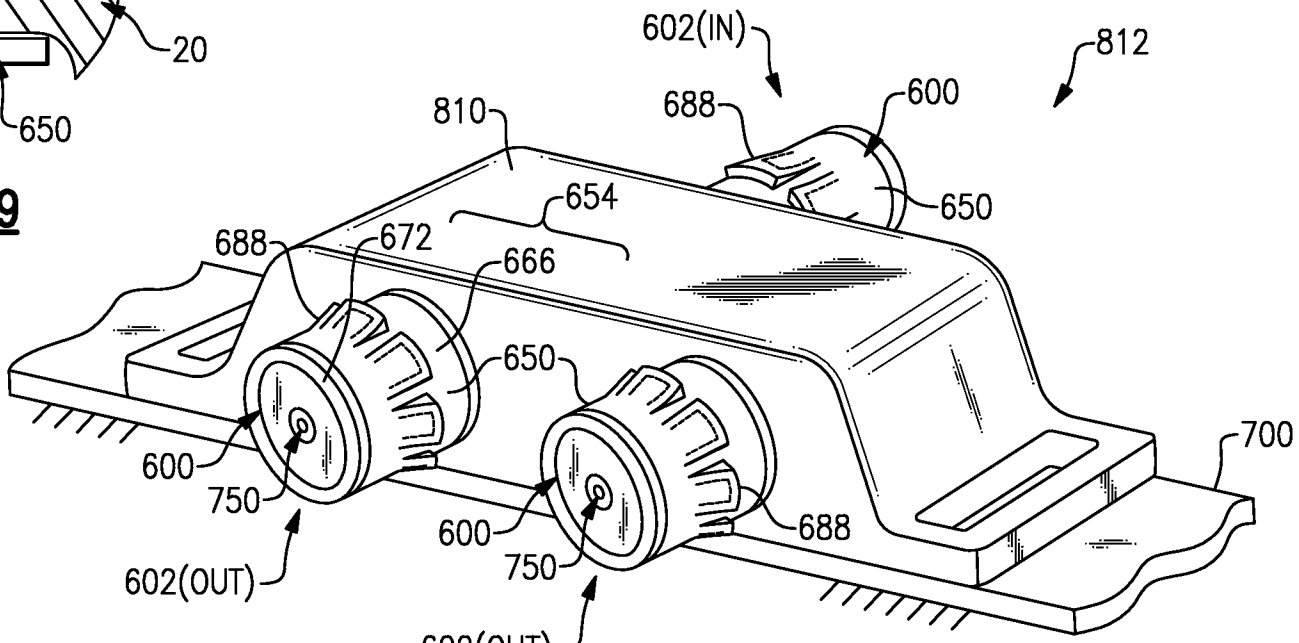
FIG. 18 depicts a perspective view of one embodiment of the coaxial port accessory integrated with the input and output ends of an in-line RF device to produce integrated input and output ports, each port having a plurality of contacts for axially engaging and rotationally disengaging a threaded coaxial cable connector.

In FIGS. 14 and 18, an in-line RF device or splitter 812, bifurcates an input signal received along an input port 602 (IN) of an integrated interface port 602. More specifically, the input signal is received by the input port 602(IN) and is split equally, or unequally, to a pair of output ports 602(OUT). The input and output ports 602(IN), 602(OUT) each include input and output conductor portions 650, 750 electrically connecting to the outer and inner conductors 614, 618, of a respective coaxial cable (not shown). The in-line RF device 812 includes a conductive housing 810 which is electrically connected to a ground source 700 for protecting the input and output signals from electrical interference, e.g., lightening strikes, electrical surges, cross-talk from other sources of RF energy, etc. Each of the input and output ports 602(IN), 602(OUT) includes a plurality of resilient contacts 688 operative to facilitate axial engagement and rotational disengagement of a threaded connector (not shown).

While the in-line RF device 812 may be fabricated with the ports 602(IN), 602(OUT) previously integrated with the housing 812, an RF device, whether in-line or otherwise, may be modified to produce the input and output ports 602(IN), 602(OUT). For example, in FIGS. 18 and 19, an RF device 612 may include one or more ports having a conventional threaded outer body for connecting to ground, and an aperture or orifice for accepting a signal-carrying lead of a coaxial cable. Such in-line RF device 812 may be modified by incorporating a port accessory 600 having a slide-on conductive outer body 854 (FIG. 19).

The slide-on outer body 854 may include one or more inwardly facing ridges or threads 860 for engaging the outwardly facing threads 864 of the conventional threaded outer body. The slide-on outer body 854 includes the same structural features described earlier in connection with the outer body 654 of the port accessory 600 including the resilient contacts 688 for axially engaging and rotationally disengaging a threaded coaxial cable connector. For example, the resilient contacts 688 may have an inclined edge corresponding to the lead or helix angle of the connector anticipated to threadably engage the resilient contacts 688. The contacts 688 may be arranged in multiple rows and may be circumferentially staggered from one row to another. Additionally, the resilient contacts 688 may be axially displaced from one contact 688 to another contact 688. That is, the axial length of the resilient contacts 688 measured from the effective hinge VH may vary. Also, the resilient contacts 688 may be radially displaced from one contact 688 to another. That is, the radius measured from elongate axis 666A may vary.

The conductive outer body 654, 854 of each port accessory 600 may be fabricated from a thin sheet of ductile metal material and stamped using a die-press. The resilient contacts 688 may be pre-cut into the metal sheet to form the length, location and angle of the inclined edge of each resilient contact. The annular rim 672 of each outer body 654 may also be formed in the die-press mold. While each resilient contact 688 defines a substantially U-shape, the resilient contact 688 may have different shapes including a C, V, W or M-shape, provided that an edge is formed which engages a working surface of the threaded coaxial cable connector.

The outer body 654, 854 of each port accessory 600 may also be constructed of a conductive material suitable for data transmission, such as a metal or alloy including copper, copper-clad aluminum ("CCA"), copper-clad steel ("CCS") or silver-coated copper-clad steel ("SCCCS"). The conductive outer body 654, furthermore, may be fabricated from a combination of metal and non-metal, e.g., fiber reinforced composite, thermoset and thermoplastic materials, provided that a proper conductive ground path is maintained between the conductive post 624 and the ground source 700.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. An interface port comprising:

a body configured to be in electrical communication with a grounding conductor of a coaxial cable connector, configured to slideably receive a threaded coupler of the coaxial cable connector along an axis to engage the threaded coupler, and configured to rotate about the axis to disengage a thread profile surface of the threaded coupler;

the body defining a substantially cylindrical outer periphery and an annular rim having a front face surface, the outer periphery defining a conductive outer surface and an elongate axis, the annular rim projecting inwardly from a forward portion of the outer periphery toward the elongate axis, the front face of the annular rim configured to be electrically connected to the grounding conductor of the coaxial cable connector, the cylindrical outer periphery, furthermore, having a plurality of resilient tabs arranged about an outer circumference of the body, each resilient tab having a free end extending radially outward from a connected end and being inclined relative to the elongate axis, the free end of each resilient tab being configured to move between a predisposed position and an engaged position, the free and connected ends each defining a distance from the elongate axis in each of the predisposed and engaged positions, the predisposed position characterized by the distance of the free ends being farther away from the axis than distance of the connected ends, the engaged position being characterized by the distance of the free ends being closer to the axis than the distance to the axis when the free ends are in the predisposed position, and resulting from the cable connector being axially slid forward along the axis to at least partially receive the body and until an angled edge of each free end engages a thread profile surface of the thread, the free ends configured to engage the thread profile surface in response to a force on the coaxial cable connector acting in a rearward direction along the axis, the connecting end of each resilient tab defining an effective hinge to outwardly bias the free end into root portion of the threaded coupler such that the free end may engage the thread profile surface of at least one of the spiral threads in the engaged position, the free end of each resilient tab defining an angled edge corresponding to a lead angle of the spiral thread of the threaded coupler, the angled edge engaging the working surface of the threaded coupler to disengage each resilient tab from the threaded coupler.

2. The interface port claim 1, wherein each resilient tab defines an axial length from the connected end to the free end, and wherein the axial length of one resilient tab is different than the axial length of another resilient tab.

3. The interface port of claim 1, wherein each resilient tab defines a radial length from the elongate axis, and wherein the radial length of one resilient tab is different than the radial length of another resilient tab.

4. The interface port of claim 1, wherein the body comprises a plurality of resilient tabs around the circumference, wherein each resilient tab defines an angled edge, and wherein the angled edges collectively correspond to the lead angle of the spiral thread of the threaded coupler.

5. The interface port of claim 1, wherein the body defines a first conductor portion and an inner cavity configured to receive a dielectric core and a second conductor portion.

6. The interface port of claim 1, wherein the body defines a first conductor portion and an inner cavity, and further comprising a second conductor portion having a conductive surface defining an orifice configured to receive a signal carrying lead of the cable connector, and a dielectric core disposed between and electrically insulating the second conductor portion from the first conductor portion.

7. A coaxial interface device comprising:

a body extendable along an axis, the body comprising a circumference; and a plurality of tabs supported by the body, the tabs being spaced apart from each other along the circumference, each of the tabs comprising a connected end which is connected to the body and a free end, the free ends being located further away from the axis than the connected ends, each of the free ends comprising an angled edge, the angled edges being oriented so as to be threadably compatible with a thread of a coaxial cable connector, the tabs being configured to move between a predisposed position and an engaged position, wherein, in the predisposed position, the free ends are predisposed to be further away from the axis than the connected ends, wherein, in the engaged position, the free ends are closer to the axis than when in the predisposed position, the engaged position resulting from the coaxial cable connector being pushed in a forward direction along the axis to at least partially receive the body until the free ends engage a thread portion of the thread, the engagement with the thread portion counteracting any pulling force on the coaxial cable connector acting along the axis in a rearward direction, wherein the angled edges are configured to enable the coaxial cable connector to be rotatably removed from the coaxial interface device.

8. The coaxial interface device of claim 7, wherein each resilient tab defines an axial length from the connected end to the free end, and wherein the axial length of one resilient tab is different than the axial length of another resilient tab.

9. The coaxial interface device of claim 7, wherein each resilient tab defines a radial length from the elongate axis, and wherein the radial length of one resilient tab is different than the radial length of another resilient tab.

10. The coaxial interface device of claim 7, wherein the body comprises a plurality of resilient tabs around the circumference, wherein each resilient tab defines an angled edge, and wherein the angled edges collectively correspond to a lead angle of a spiral thread of the threaded coupler.

11. The coaxial interface device of claim 7, wherein the body defines a first conductor portion and an inner cavity configured to receive a dielectric core and a second conductor portion.

12. The coaxial interface device of claim 10, wherein each of the resilient tabs defines a shape, the shape being selected from one of U, C, V, W and M-shape.

13. An interface port accessory comprising:

a body extendable along an axis and comprising an outer periphery defining an outer surface; and at least one resilient tab extending a distance from the outer surface of the body, the at least one resilient tab configured to slide along an axis to engage a working surface of a threaded coupler of a cable connector, and configured to axially retain the connector relative to the axis, the at least one resilient tab configured to disengage the working surface of the threaded coupler in response to rotation of the threaded coupler about the axis.

14. The interface port accessory of claim 13, comprising a plurality of resilient tabs disposed about the outer periphery of the body.

15. The interface port accessory of claim 13, wherein each resilient tab defines an axial length from the connected end to the free end, and wherein the axial length of one resilient tab is different than the axial length of another resilient tab.

16. The interface port accessory of claim 13, wherein each resilient tab defines a radial length from the elongate axis, and wherein the radial length of one resilient tab is different than the radial length of another resilient tab.

17. The interlace port accessory of claim 13, wherein the body comprises a plurality of resilient tabs around the circumference, wherein each resilient tab defines an angled edge, and wherein the angled edges collectively correspond to a lead angle of a spiral thread of the threaded coupler.

18. The interface port accessory of claim 13, wherein the body defines a first conductor portion and an inner cavity configured to receive a dielectric core and a second conductor portion.

19. The interface port accessory of claim 14, wherein each of the resilient tabs defines a shape, the shape being selected from one of U, C, V, W and M-shape.

20. The interface port accessory of claim 14, wherein the plurality of resilient tabs defines at least two rows of tabs, each resilient tab defining an angled edge corresponding to a lead angle of a spiral thread of the threaded coupler.

* * * * *